US006626812B1

(12) United States Patent
Harding et al.

(10) Patent No.: US 6,626,812 B1
(45) Date of Patent: Sep. 30, 2003

(54) CUSHIONING CONVERSION MACHINE AND METHOD

(75) Inventors: Joseph J. Harding, Mentor, OH (US); Richard O. Ratzel, Westlake, OH (US); Thomas E. Manley, Mentor, OH (US); Michael J. Lencoski, Claridon Township, OH (US); Mike J. Timmers, Landgraaf (NL); Rogers P. M. Rinkens, Brunssum (NL); Kurt Küng, Daghsen (CH); Livio Marchioni, Affoltern a.A (CH)

(73) Assignee: Ranpak Corp., Concord Township, OH (US)

( * ) Notice: Subject to any disclaimer, the term of this patent is extended or adjusted under 35 U.S.C. 154(b) by 29 days.

(21) Appl. No.: 09/712,556

(22) Filed: Nov. 14, 2000

Related U.S. Application Data

(63) Continuation of application No. PCT/US99/10778, filed on May 14, 1999.

(60) Provisional application No. 60/105,136, filed on Oct. 21, 1998, provisional application No. 60/099,237, filed on Sep. 4, 1998, and provisional application No. 60/085,721, filed on May 15, 1998.

(51) Int. Cl.[7] ..... B31F 7/00

(52) U.S. Cl. ..... 493/350; 493/352; 493/407; 493/967; 493/464

(58) Field of Search ..... 493/185, 350, 493/352, 354, 407, 464, 967

(56) References Cited

U.S. PATENT DOCUMENTS 4,237,776 A * 12/1980 Ottaviano ..... 493/967
4,717,613 A * 1/1988 Ottaviano
5,061,543 A * 10/1991 Baldacci
5,211,620 A * 5/1993 Ratzel et al. ..... 493/407
5,713,825 A * 2/1998 Ratzel
5,755,656 A * 5/1998 Beierlorzer

FOREIGN PATENT DOCUMENTS

EP 0679504 A * 11/1995
EP 0759849 A * 3/1997
WO WO96/40496 * 12/1996

* cited by examiner

*Primary Examiner*—Eugene Kim
*Assistant Examiner*—Sameh Tawfik
(74) *Attorney, Agent, or Firm*—Renner, Otto, Boisselle & Sklar, LLP

(57) ABSTRACT

A cushioning conversion machine (100, 200, 300, 400, 500, 600, 700, 800, 900) comprising a conversion assembly (101, 201, 301, 401, 501, 601, 701, 801, 901) which converts a sheet stock material into a three-dimensional strip of cushioning. The conversion assembly (101, 201, 301, 401, 501, 601, 701, 801, 901) includes a forming assembly (120, 220, 320, 420, 520, 620, 720, 820, 920) that forms the stock material into a strip of stock material. The forming assembly (120, 220, 320, 420, 520, 620, 720, 820, 920) comprises an external forming device (122, 222, 322, 422, 522, 622, 722, 822, 922) and an internal forming device (124, 224, 324, 424, 524, 624, 724, 824, 924). The internal forming device (124, 224, 324, 424, 525, 624, 724, 824, 924) includes interacting and/or mandrel portions (164, 264, 364, 464, 564, 664, 764, 864, 964) which internally interact with lateral portions of the strip of stock material to internally reshape the cross-sectional geometry of the strip.

10 Claims, 29 Drawing Sheets

CUSHIONING CONVERSION MACHINE AND METHOD

This is a continuation of International Application No. PCT/US99/10778, filed on May 14, 1999 which claims priority from U.S. Provisional Application Nos. 60/085,721, filed May 15, 1998; 60/099,237, filed Sep. 4, 1998; and 60/105,136, filed Oct. 21, 1998.

FIELD OF THE INVENTION

This invention relates generally as indicated to a cushioning conversion machine and method. More particularly, this invention relates to improved forming assemblies and/or forming steps for cushioning conversion machines and methods.

BACKGROUND OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alternative. Paper is biodegradable, recyclable and renewable; making it an environmentally responsible choice for conscientious industries. While paper in sheet form could possibly be used as a protective packaging material, it is usually preferable to convert the sheets of paper into a relatively low density pad-like cushioning dunnage product. This conversion may be accomplished by a cushioning conversion machine, such as those disdosed in U.S. Pat. Nos. 4,026,298; 4,085,662; 4,109,040; 4,237,776; 4,717,613; 4,750,896; 4,884,999; 5,061,543; 5,188,581 and/or 5,607,383. (These patents are assigned to the assignee of the present application and their entire disclosures are hereby incorporated by reference.)

Each of the cushioning conversion machines disclosed in the above-identified patents includes a conversion assembly which converts sheet-like stock material into a three-dimensional strip of cushioning. The conversion assembly includes a forming assembly which forms the sheet-like stock material into a strip of stock material having lateral pillow-like portions. The conversion assembly also includes a feeding assembly which is positioned downstream of the forming assembly and which pulls the stock material through the forming assembly.

The forming assemblies in the above-identified patents each comprise an external forming device and an internal forming device which are positioned within a common envelope defined by the machine's housing. The stock material travels through the external forming device and around the internal forming device as it passes through the forming assembly to form the strip of stock material. The external forming device is a converging chute having an inlet, an outlet and substantially continuous walls therebetween which define a turning space. In the external forming device (or chute) disclosed in U.S. Pat. No. 5,607,383, the upstream edges of certain walls are outwardly flared in a trumpet-like fashion to facilitate passage of the stock material into the turning space and/or to prevent any tears in the stock material during this passage.

In U.S. Pat. Nos. 4,026,298; 4,085,662; 4,109,040 and/or 4,237,776, the internal forming device (called a pusher mechanism) includes a body which is made of a bar-like material, such as metal rod, and which is triangular shaped when viewed from the top. During the forming process, converging leg portions of the body define a co-planar turning perimeter around which lateral regions of the stock material are inwardly turned. These converging leg portions and also lateral cross-leg portions form a co-planar holding surface that holds central regions of the stock material as its lateral regions are inwardly turned. The body is positioned entirely within the external forming device with its downstream end being positioned slightly upstream of the chute's outlet.

In U.S. Pat. No. 4,717,613, the internal forming device (called a forming frame) includes a planar body and three perpendicular ribs, all of which are made of a bar-like material, such as metal rod. The body is V-shaped when viewed from the top. The ribs are U-shaped when viewed from the device's upstream end and decrease in height and width in the downstream direction. During the forming process, converging leg portions of the body define a co-planar turning perimeter around which lateral regions of the stock material are inwardly turned and bottom leg portions of the ribs define a co-planar holding surface that holds central regions of the stock material. The body and ribs are all positioned entirely within the turning space of the external forming device and the device's downstream end (i.e., the downstream end of the V-shaped body) is located just upstream of the chute's outlet.

In U.S. Pat. No. 4,750,896, the internal forming device (called a forming frame) has a construction similar to the internal device disclosed in U.S. Pat. No. 4,717,613, except that it includes only two ribs. During the forming process, converging leg portions of the device's body define a co-planar turning perimeter and bottom leg portions of the its ribs define a co-planar holding surface. This device is positioned only partially within the chute in that it has upstream portions situated outside of the chute and downstream portions situated within the chute. The device's downstream end is positioned within the turning space just upstream of the chute's outlet.

In U.S. Pat. Nos. 4,884,999; 5,061,543 and/or 5,188,581, the internal forming device (called a former member) includes an elongated bar-like body having a rectangular cross-section. This internal forming device is designed to coact with a smaller chute to produce a narrower strip of cushioning. In any event, during the conversion process, the top lateral edges of the body define a co-planar turning perimeter and the bottom surface of the body defines a co-planar holding surface. The upstream portions of the rectangular body are positioned upstream of the chute's inlet and the device's downstream end is positioned just upstream of the chute's outlet.

In U.S. Pat. No. 5,607,383, the internal forming device (called a forming member) comprises a first leg portion, a second leg portion and a bight portion which performs as a living hinge between the leg portions. During the forming process, the bottom surface of the second leg portion defines a co-planar holding surface that holds the central region of the stock material as its lateral regions are inwardly turned. The first leg portion is attached to the chute's top wall along a laterally center line thereof, the bight portion is positioned upstream of the chute's inlet, and the second leg portion extends from the bight portion into the chute's turning space. The device's downstream end (i.e., the downstream end of the second leg portion) is positioned within the turning space just upstream of the chute's outlet.

Thus, over the years, forming assemblies have been modified, improved, or otherwise changed. Despite these past modifications, improvements, and changes, the inventors believe that a need remains for further cushioning conversion machines and methods which produce cushioning strips having enhanced qualities and/or having different shaped cross-sectional geometries. Moreover, irrespective of particular qualities and geometries, environmental and other concerns provide a constant desire for new cushioning products and for machines/methods for producing such products.

SUMMARY OF THE INVENTION

The present invention provides a cushioning conversion machine including a conversion assembly which converts sheet-like stock material into a three-dimensional strip of cushioning. The conversion assembly includes a forming assembly which forms the sheet-like stock material into a strip of stock material having lateral pillow-like portions. Preferably, the conversion assembly also includes a feeding assembly that feeds the stock material through the forming assembly. More preferably, the feeding assembly is positioned downstream of the forming assembly and pulls the stock material through the forming assembly.

The forming assembly comprises an external forming device and an internal forming device that are preferably positioned within a common envelope defined by the machine's housing. The stock material travels through the external forming device and around the internal forming device as it passes through the forming assembly to form the strip of stock material.

The external forming device has an inlet, an outlet and surfaces therebetween which define a turning space. The surfaces of the external forming device radially restrict the stock material as it travels through the turning space to cause inward turning of the lateral regions of the stock material to form the strip of stock material. Preferably, the external forming device is a chute having substantially continuous walls extending between the inlet and the outlet. More preferably, the external forming device is a converging chute whereby its inlet is of greater area than its outlet and its walls taper inwardly in the downstream direction.

According to one preferred embodiment of the invention, the internal forming device has at least one interacting portion which is positioned downstream of the outlet of the external forming device and which is positioned to internally interact with lateral portions of the strip of stock material. In this manner, the strip of stock material has a certain cross-sectional geometry when it emerges from the outlet of the external forming device and the interacting portions then internally reshape this cross-sectional geometry. An extruding device may be positioned downstream of the outlet of the external forming device. Such an extruding device would be used to externally coact with the interacting portion(s) to re-shape the cross-sectional geometry of the strip of stock material.

According to another preferred embodiment of the invention, the internal forming device comprises a pair of mandrel portions symmetrically positioned relative to the turning space defined by the external forming device. The mandrel portions are located on at least one supporting portion and the mandrel portions have a greater cross-sectional area than the supporting portion(s). The mandrel portions may be positioned downstream of the outlet of the external forming device or may be positioned within the turning space of the external forming device (i.e., upstream of the outlet). In the latter case, the mandrel portions may be positioned adjacent the outlet or may be positioned approximately intermediate the inlet and the outlet of the external forming device.

According to another preferred embodiment of the invention, the internal forming device comprises a least one interacting portion which interacts with the strip of stock material to effect its cross-sectional geometry and a supporting portion which is used to mount the interacting portion(s). The supporting portion is mounted to the machine's housing downstream of the outlet of the external forming device. The position of the interacting portion(s) is preferably downstream of the outlet of the external forming device. Additionally or alternatively, the interacting portions preferably comprise a pair of mandrel portions symmetrically positioned relative to the turning space.

According to another preferred embodiment of the invention, the internal forming device has portions which define a turning perimeter around which lateral regions of the stock material are inwardly turned. The turning perimeter includes coplanar portions and at least one mandrel portion which transversely projects beyond the coplanar portions. Preferably, the internal forming device comprises a pair of mandrel portions laterally symmetrically positioned relative to the turning space and the coplanar portions comprise a pair of mandrel-supporting portions extending through the turning space.

According to another preferred embodiment of the invention, the internal forming device comprises at least one portion defining a holding surface and a mandrel portion attached to the downstream end of this at least one portion. The holding surface holds a central region of the stock material as it travels through the turning space. The mandrel portion has a lateral section which projects laterally outward from the downstream end of the portion. The mandrel portion may be positioned downstream of the outlet of the external forming device or may be positioned upstream of the outlet of the external forming device (i.e., within the turning space). The mandrel portion may also include wing sections extending from the lateral mandrel section.

According to another preferred embodiment of the invention, the internal forming device has portions which define a holding surface that holds central regions of the stock material as it travels through the turning space. The holding surface includes at least one protrusion which projects beyond a plane extending from the upstream edge of the holding surface to the downstream edge of the holding surface. The holding surface may be defined by a leg portion which longitudinally extends through the center of the turning space and a mandrel portion attached to the downstream end of the leg portion. Alternatively, the holding surface may be defined by ribs extending downward from a V-shaped body.

According to yet another preferred embodiment of the invention, the internal forming device includes a pair of leg portions and a nose portion which joins together the downstream ends of the legs portion. The leg portions extend longitudinally through the turning space and laterally converge towards each other. The nose portion has a transverse linear section positioned centrally relative to the turning space and extending in the lateral transverse direction. Preferably, the transverse linear section extends approximately two inches in the lateral transverse direction.

These and other features of the invention are fully described and particularly pointed out in the claims. The following descriptive annexed drawings set forth in detail certain illustrative embodiments, these embodiments being indicative of but a few of the various ways in which the principles of the invention may be employed.

DRAWINGS

FIGS. 1 and 2 are top and side views, respectively, of a cushioning conversion machine 100 according to the present invention, the machine being shown without stock material passing therethrough.

FIGS. 3, 4 and 5 are isolated top, side and upstream end views, respectively, of an external forming device 122 and an internal forming device 123 of the cushioning conversion machine 100.

FIGS. 6 and 7 are isolated top and side views, respectively, of another internal forming device 124 of the cushioning conversion machine 100.

Figure 12:
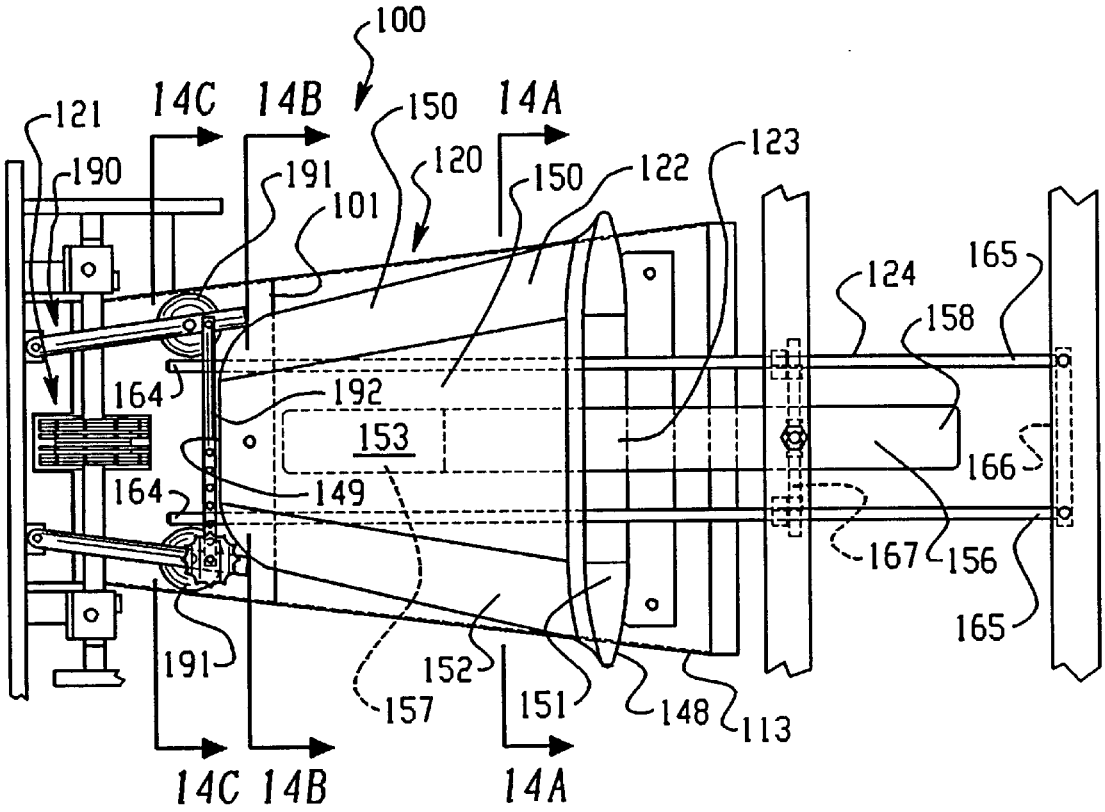
Figure 13:
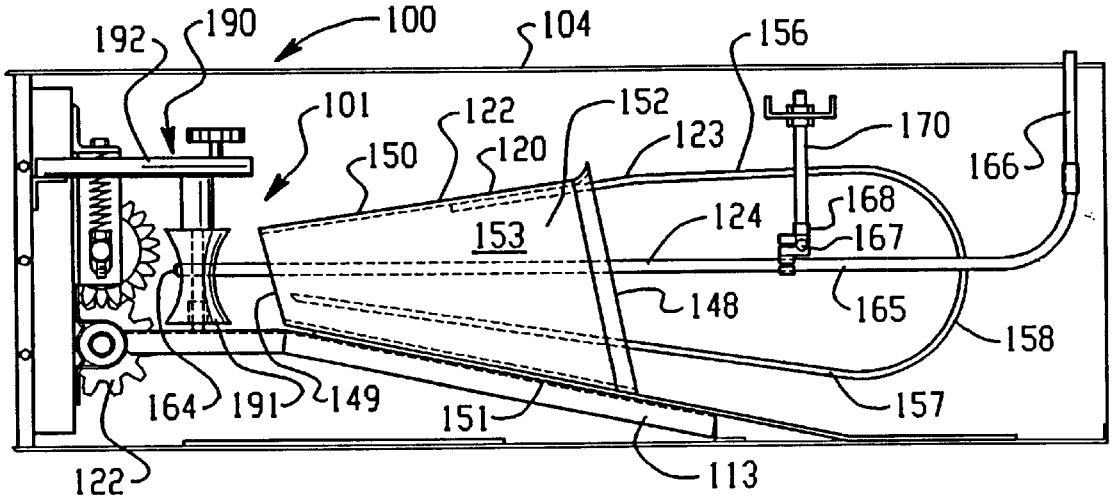

FIGS. 12 and 13 are schematic top and side views, respectively, of the cushioning conversion machine 100 modified to include an extruding device 190.

Figure 14A:
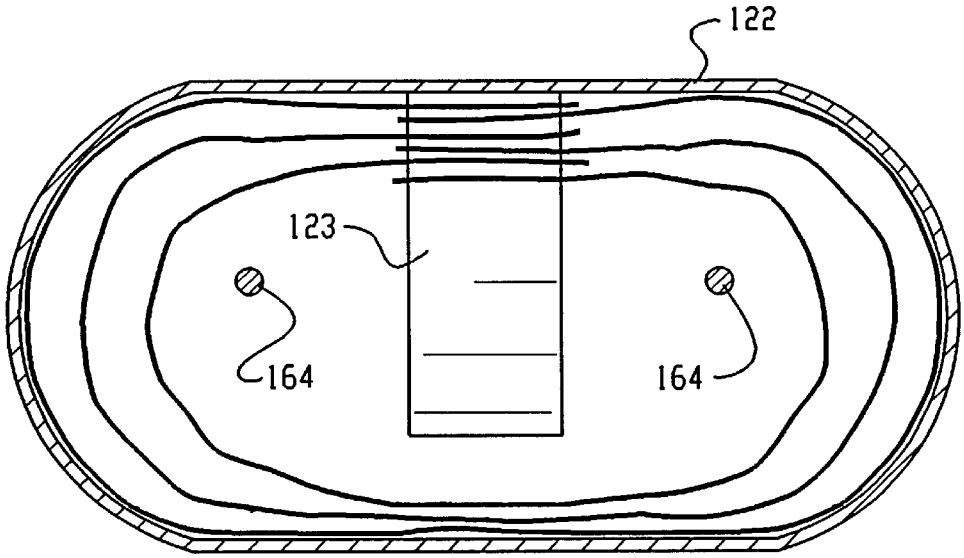
Figure 14B:
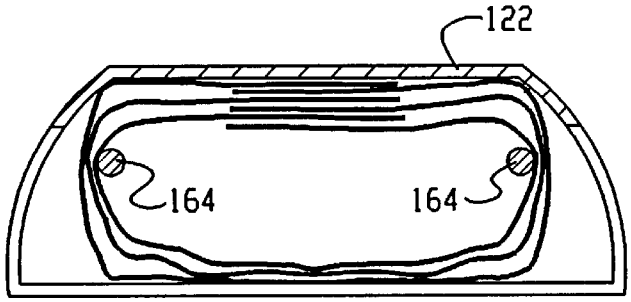
Figure 14C:
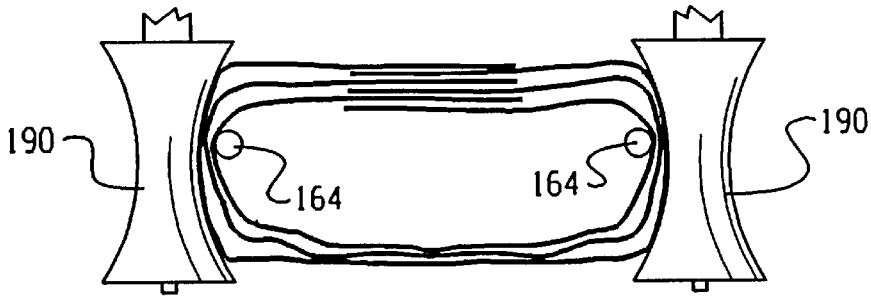

FIGS. 14A–14C are schematic cross-sections taken as indicated in FIG. 12, with stock material passing through the machine.

Figure 15:
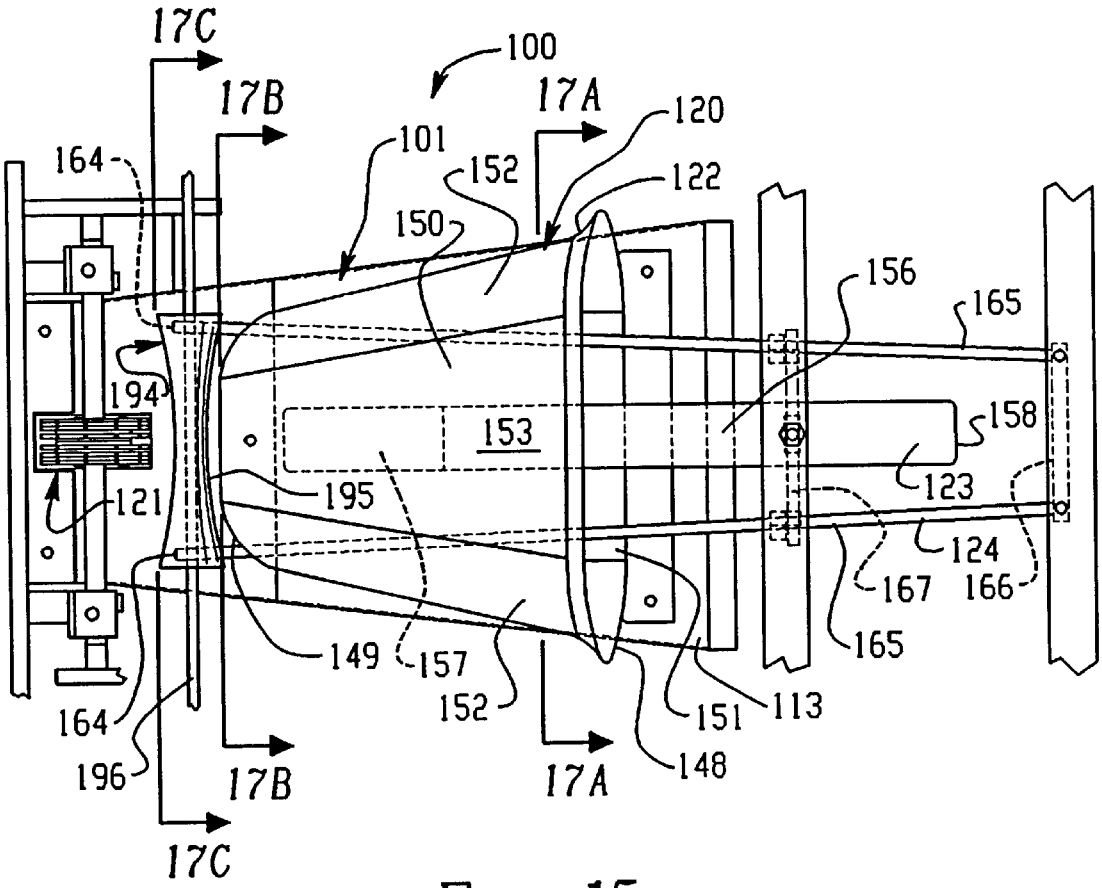
Figure 16:
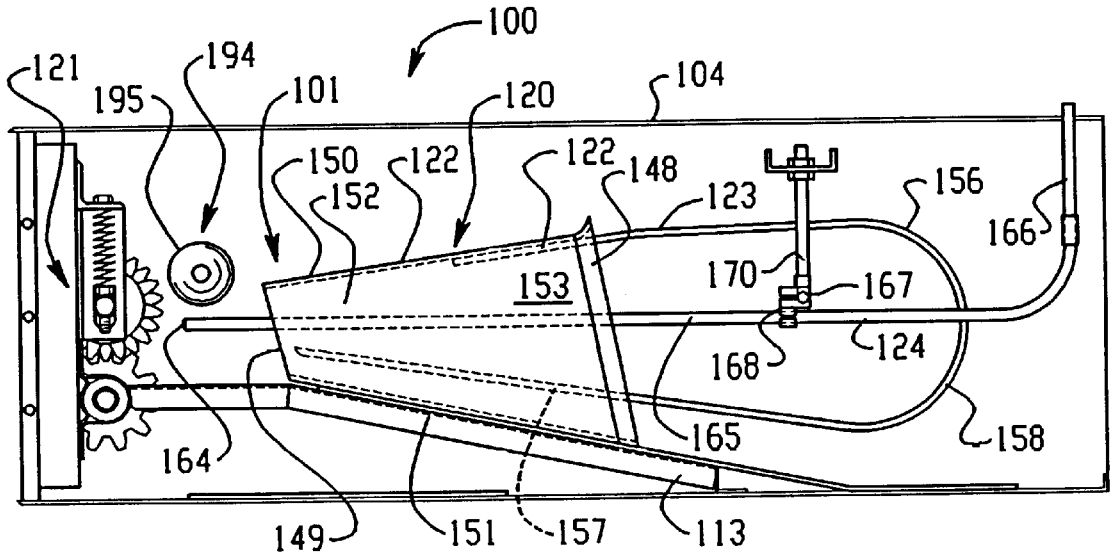

FIGS. 15 and 16 are schematic top and side views, respectively, of the cushioning conversion machine 100 modified to include another type of extruding device 194.

Figure 17A:
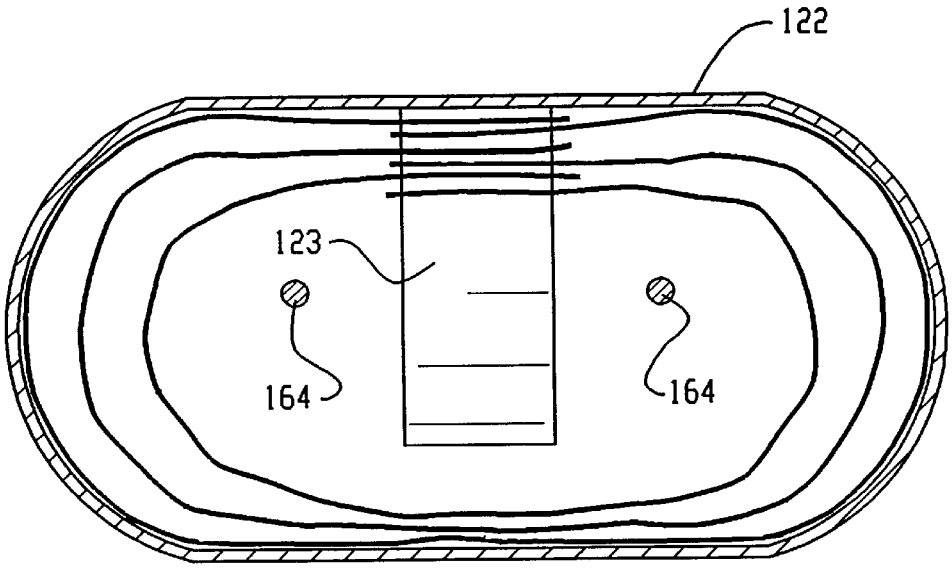
Figure 17B:
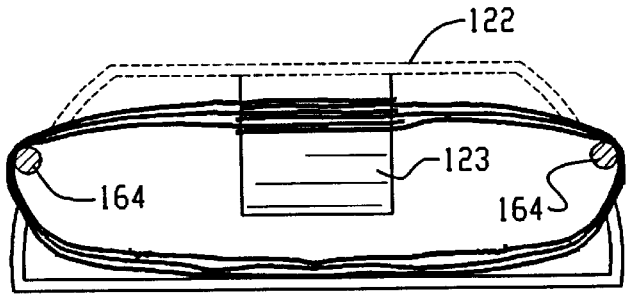
Figure 17C:
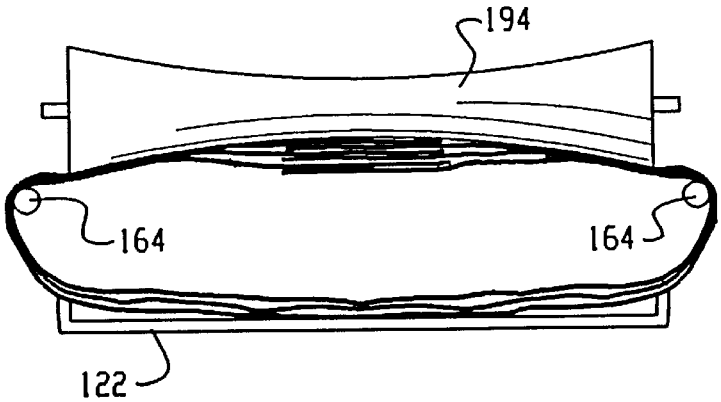

FIGS. 17A–17C are schematic cross-sections taken as indicated in FIG. 14, with stock material passing through the machine.

Figure 18:
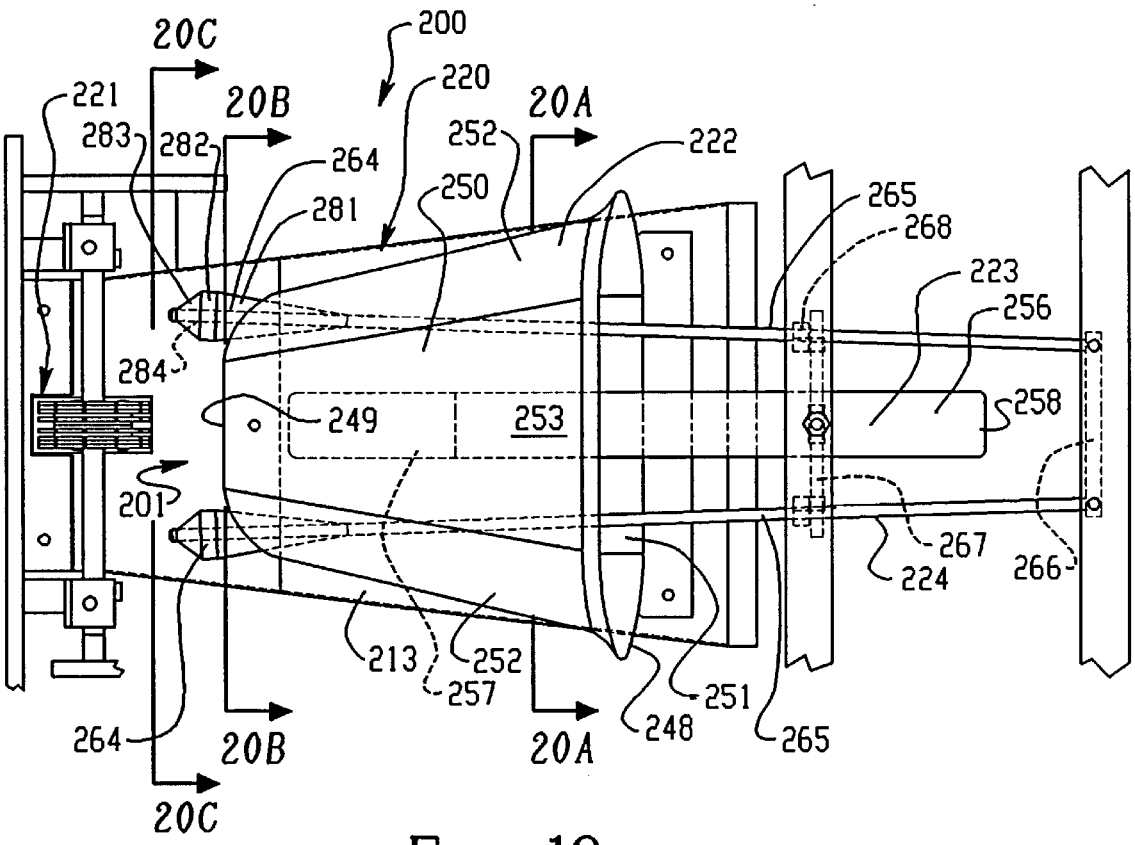
Figure 19:
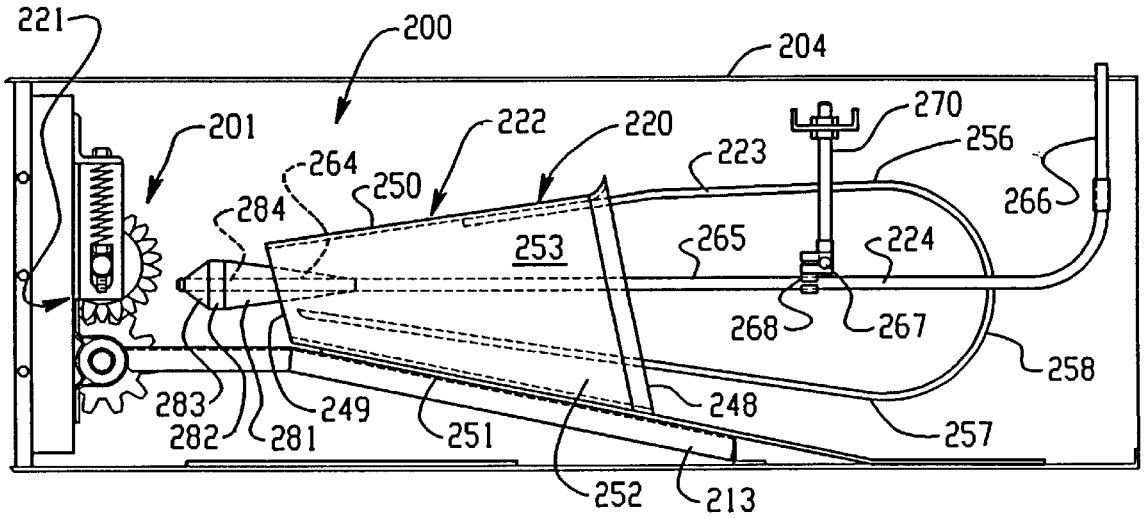

FIGS. 18 and 19 are schematic top and side views, respectively, of a cushioning conversion machine 200 according to the present invention, the machine being shown without stock material passing therethrough.

Figure 20A:
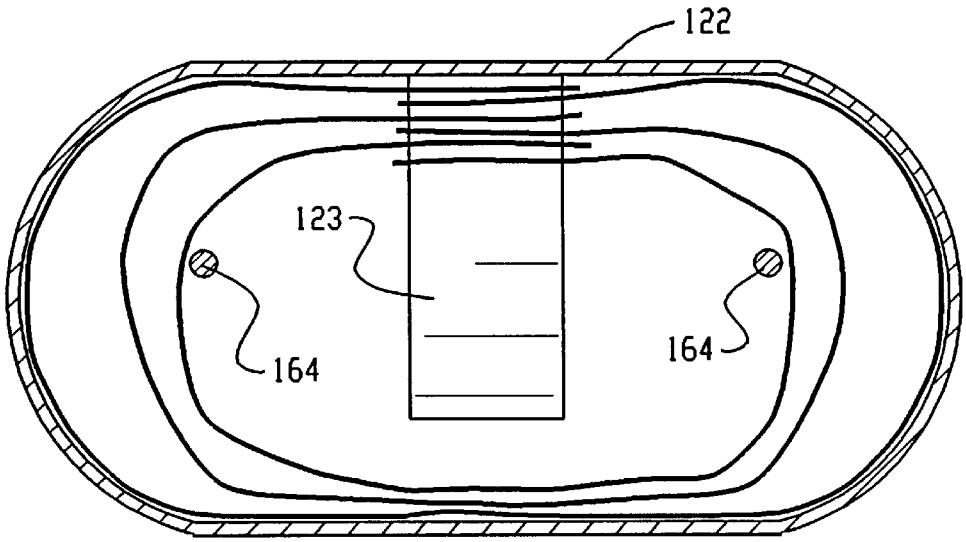
Figure 20B:
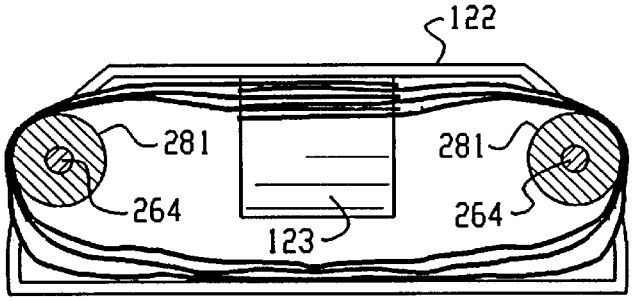
Figure 20C:
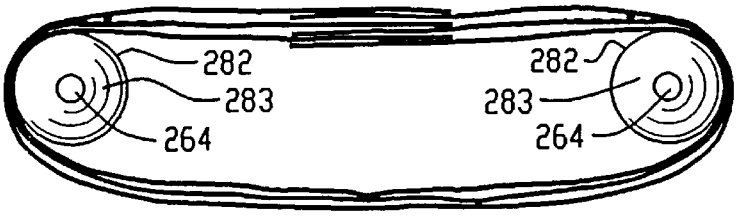

FIGS. 20A–20C are schematic cross-sectional views taken as indicated in FIG. 18, with stock material passing through the machine.

Figure 21:
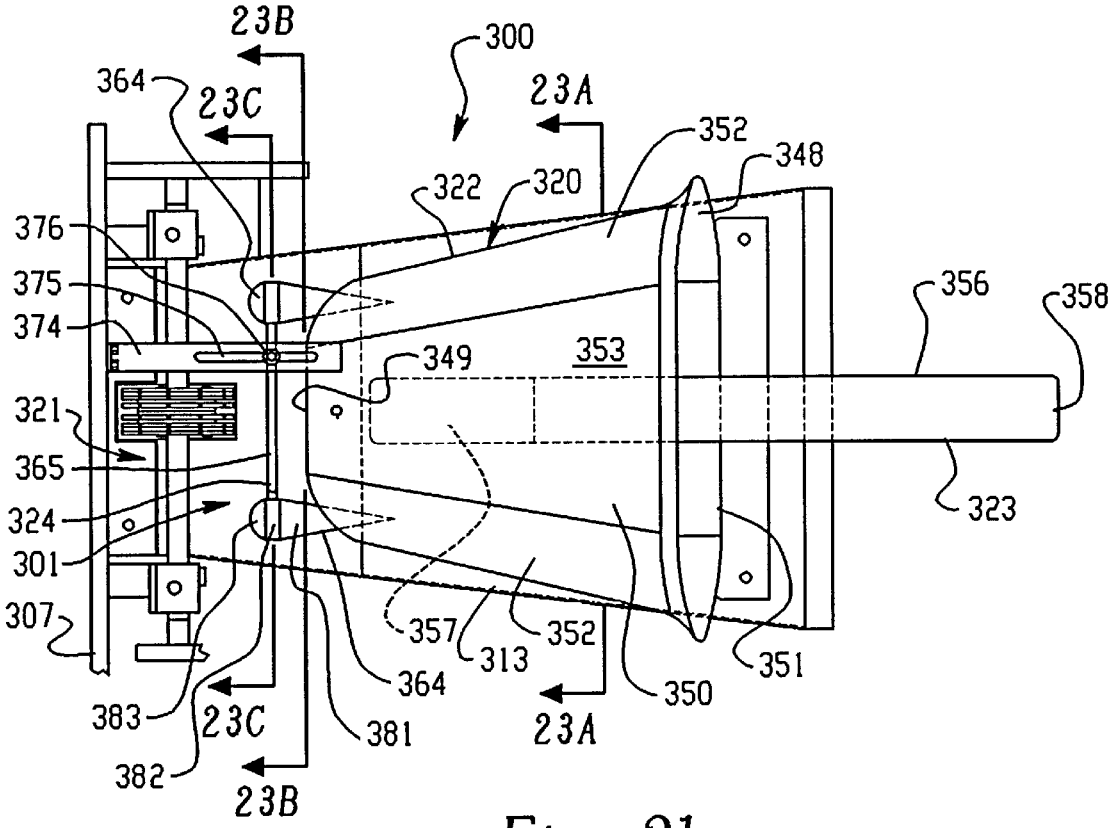
Figure 22:
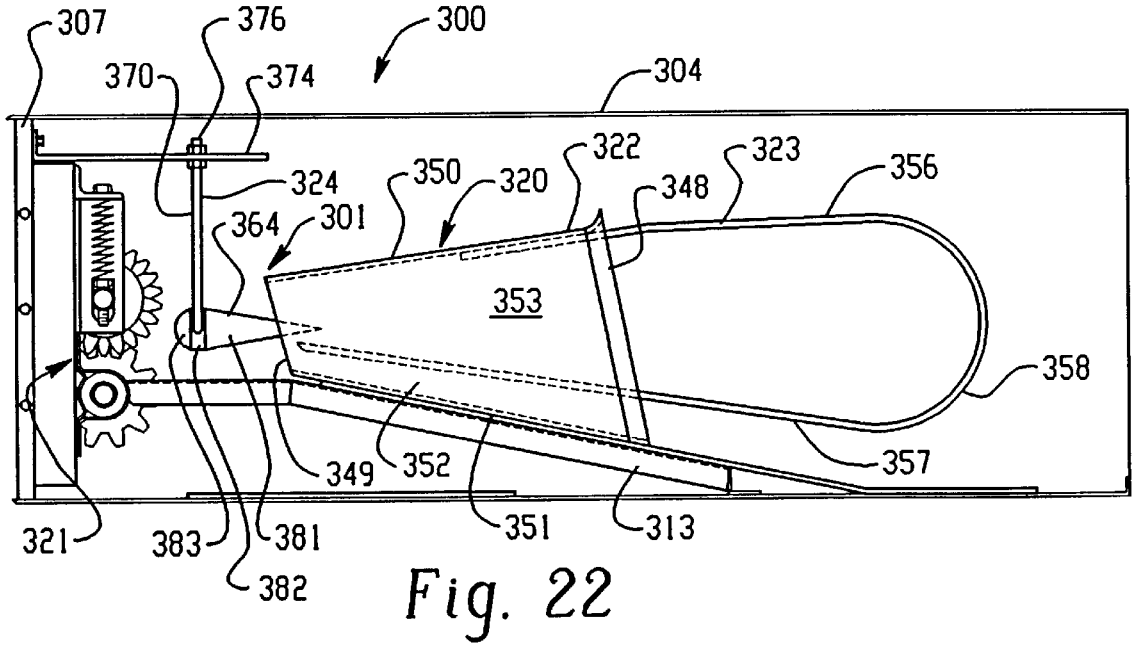

FIGS. 21 and 22 are schematic top and side views, respectively, of a cushioning conversion machine 300 according to the present invention, the machine being shown without stock material passing therethrough.

Figure 23A:
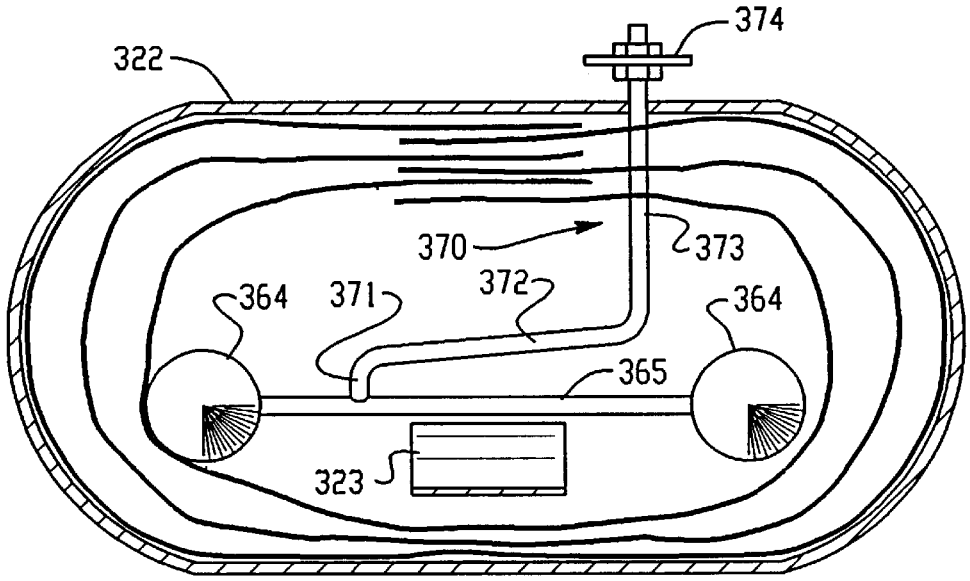
Figure 23B:
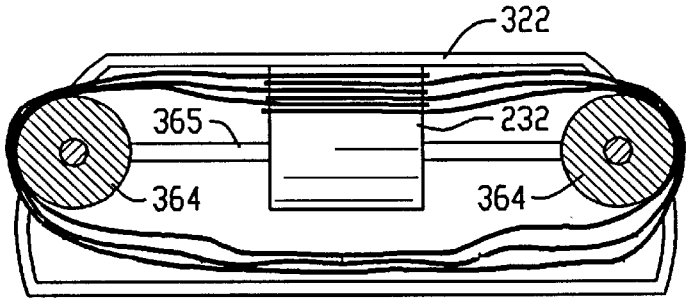
Figure 23C:
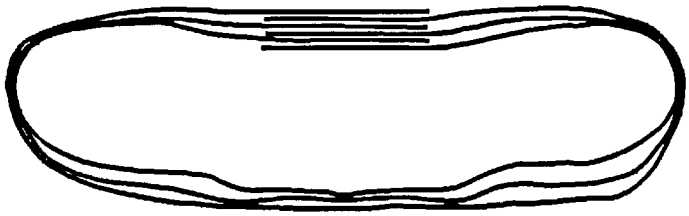

FIGS. 23A–23C are schematic cross-sectional views taken as indicated in FIG. 21, with stock material passing through the machine.

Figure 24:
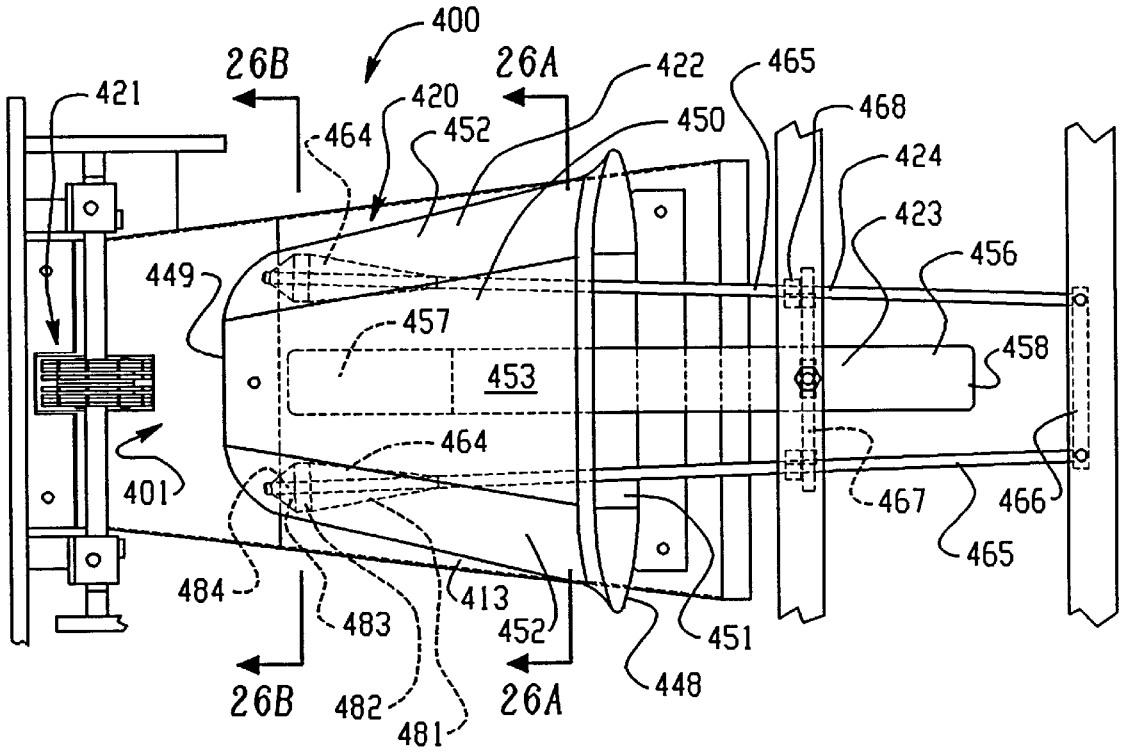
Figure 25:
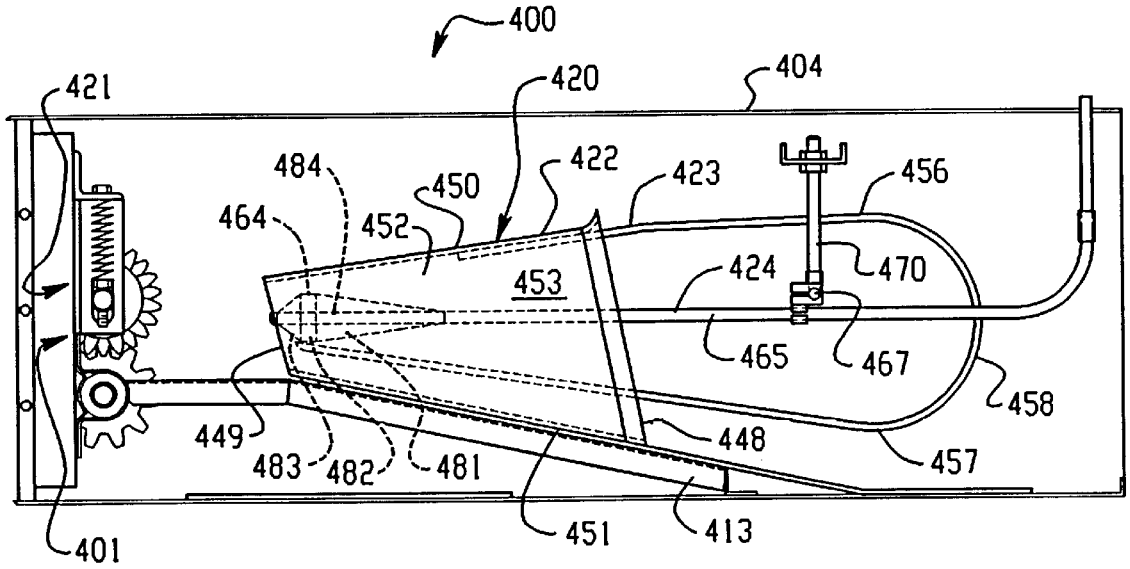

FIGS. 24 and 25 are schematic top and side views, respectively, of a cushioning conversion machine 400 according to the present invention, the machine being shown without stock material passing therethrough.

Figure 26A:
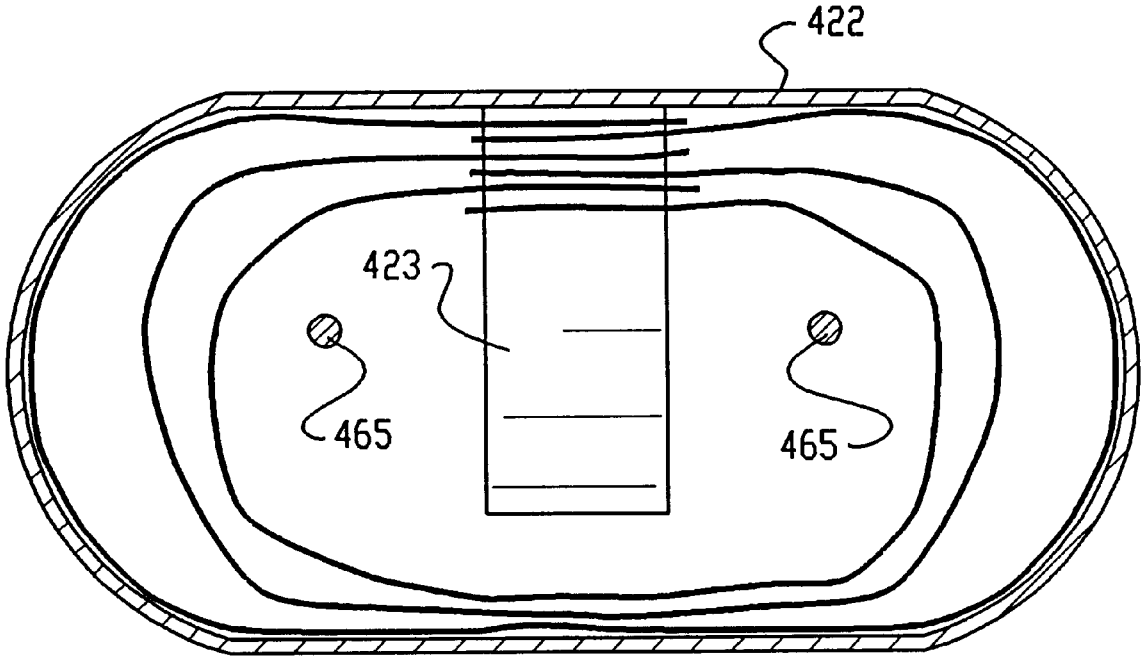
Figure 26B:
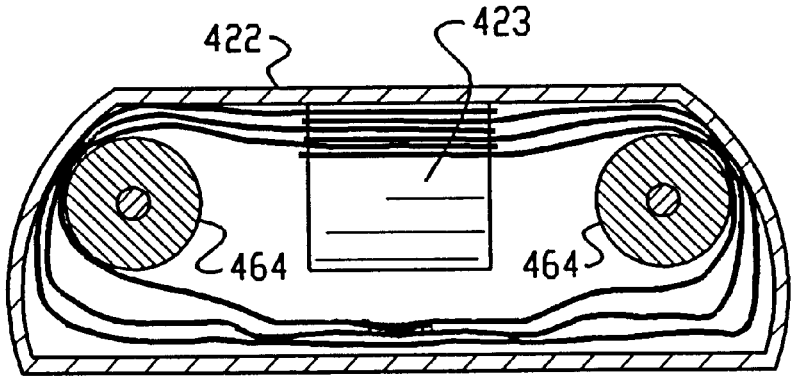

FIGS. 26A and 26B are schematic cross-sectional views taken as indicated in FIG. 23, with stock material passing through the machine.

Figure 27:
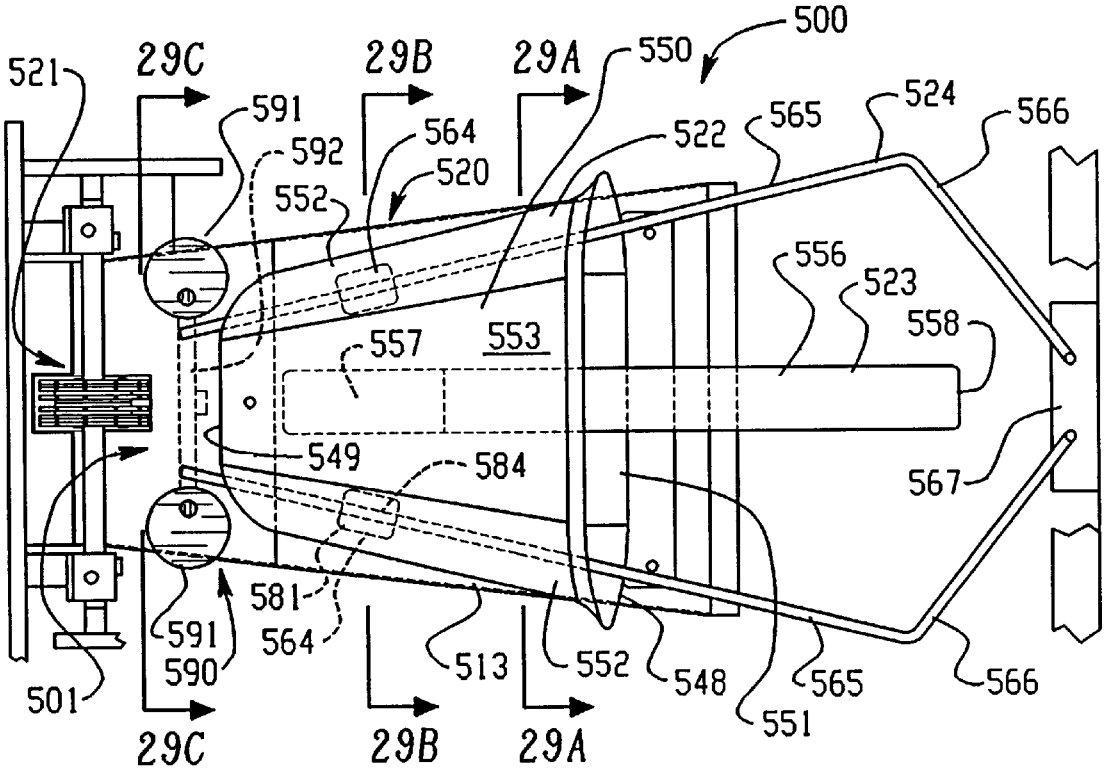
Figure 28:
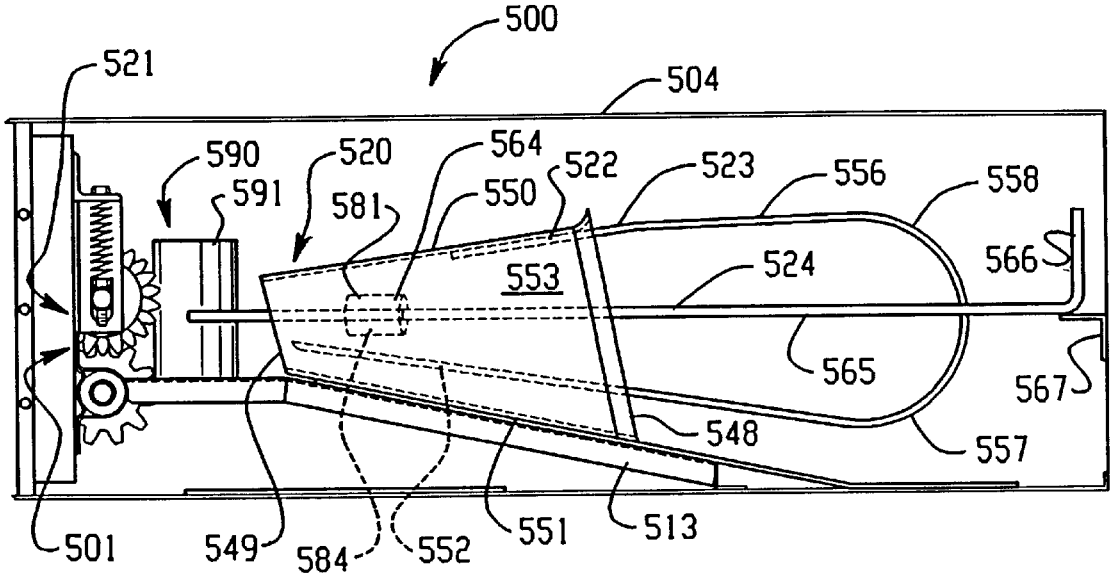

FIGS. 27 and 28 are schematic top and side views, respectively, of a cushioning conversion machine 500 according to the present invention, the machine being shown without stock material passing therethrough.

Figure 29A:
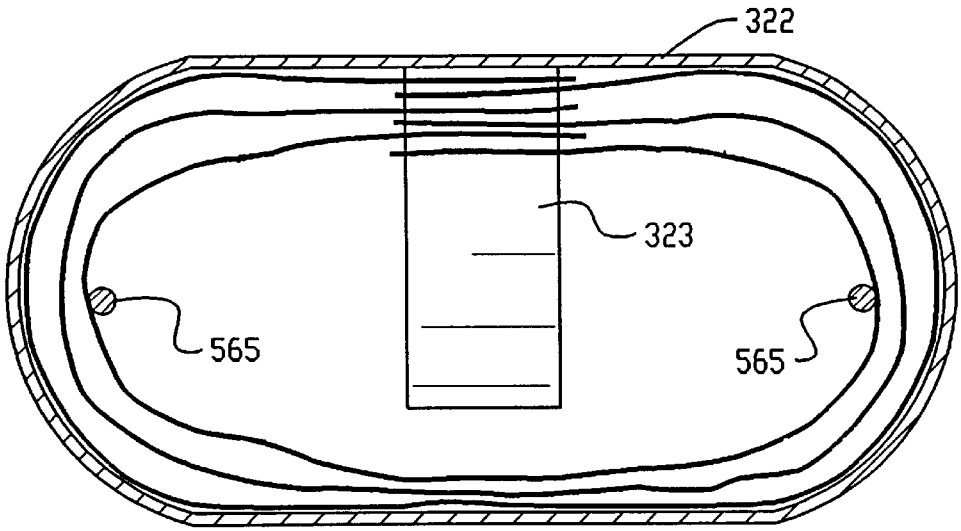
Figure 29B:
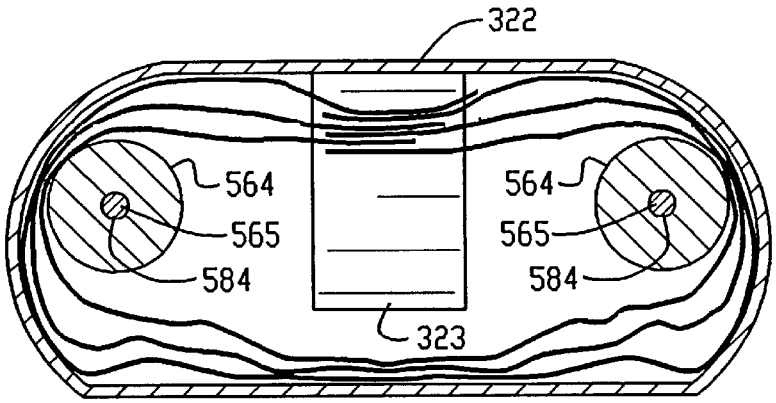
Figure 29C:
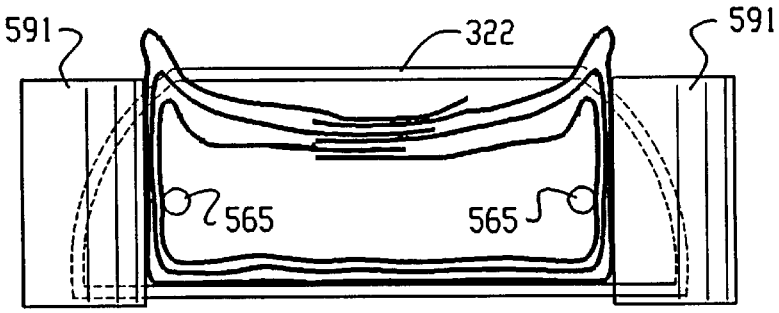

FIGS. 29A–29C are schematic cross-sectional views taken as indicated in FIG. 27, with stock material passing through the machine.

Figure 30:
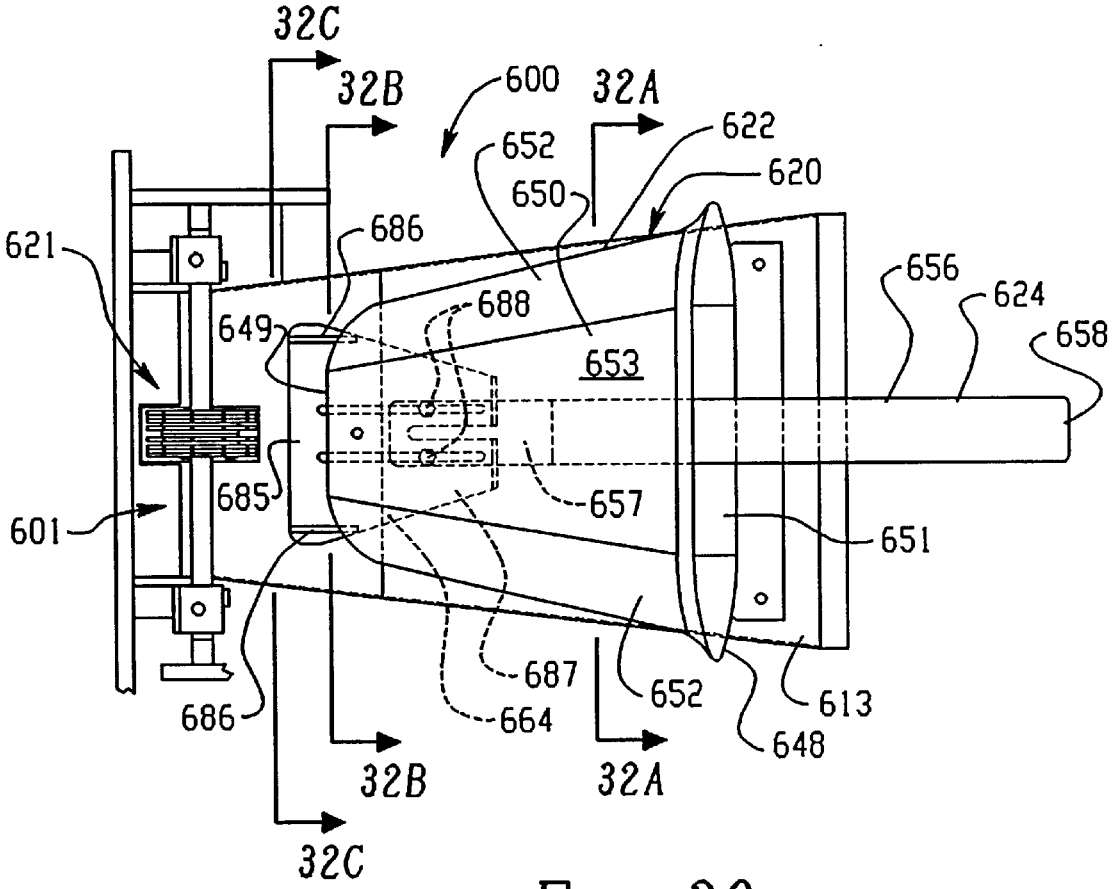
Figure 31:
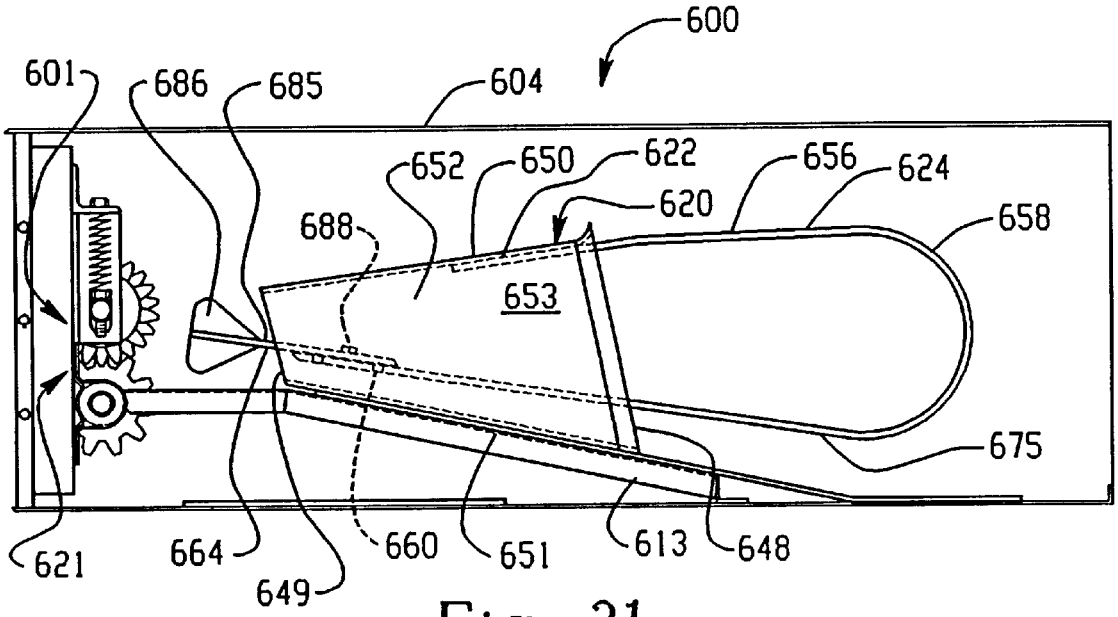

FIGS. 30 and 31 are schematic top and side views, respectively, of a cushioning conversion machine 600 according to the present invention, the machine being shown without stock material passing therethrough.

Figure 32A:
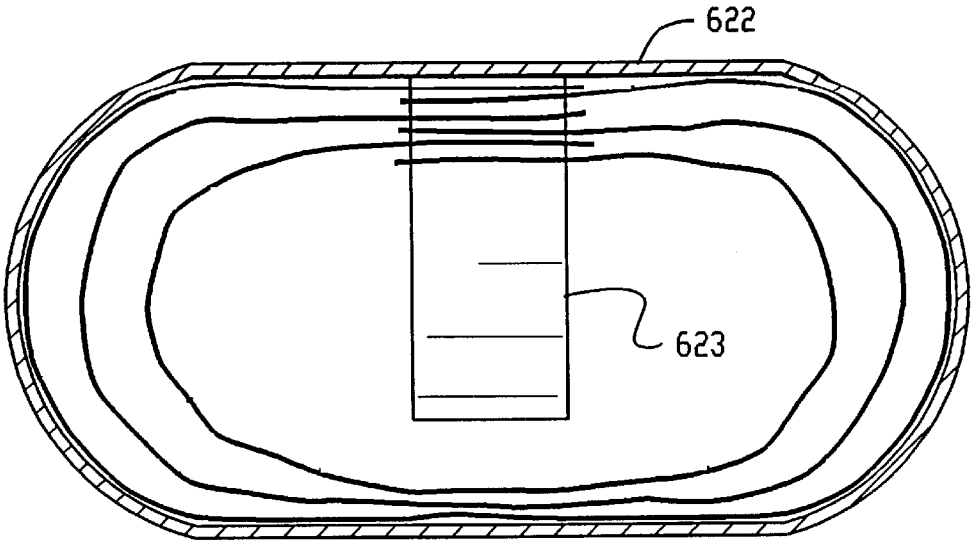
Figure 32B:
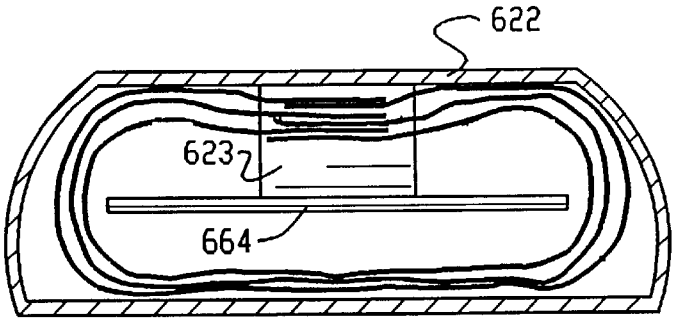
Figure 32C:
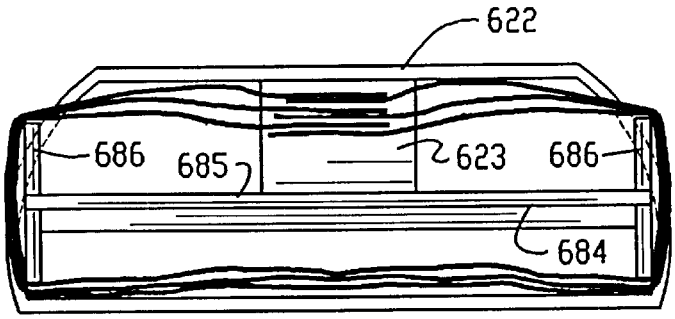

FIGS. 32A–32C are schematic cross-sectional views taken as indicated in FIG. 30, with stock material passing through the machine.

Figure 33:
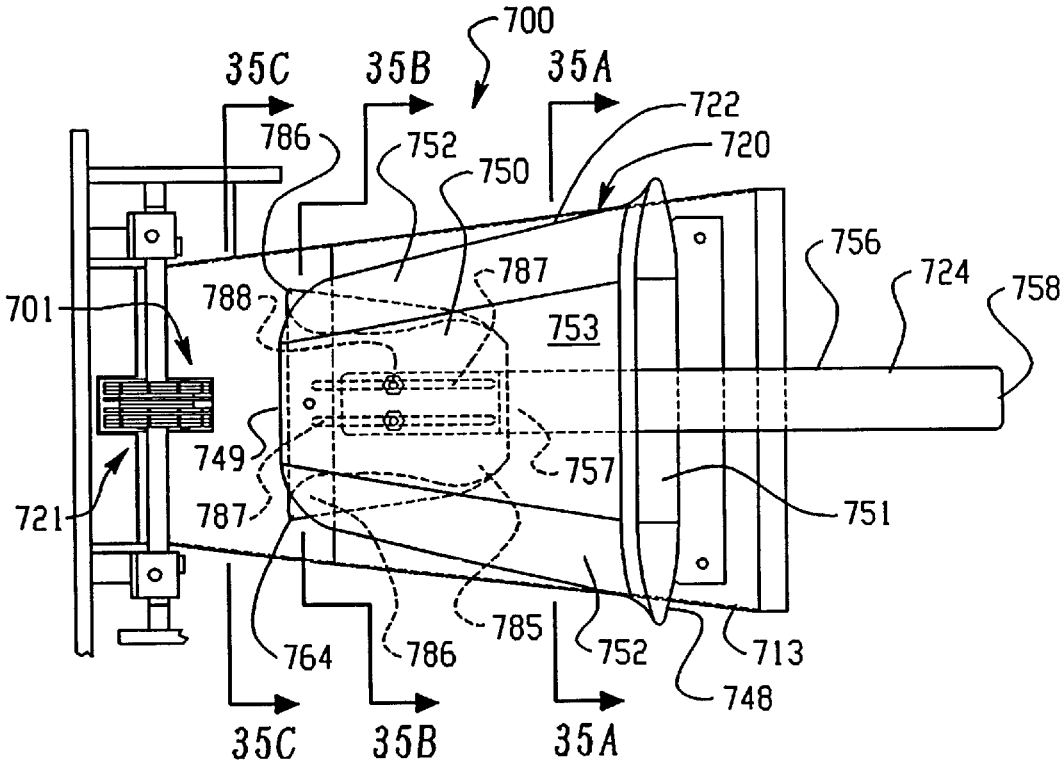
Figure 34:
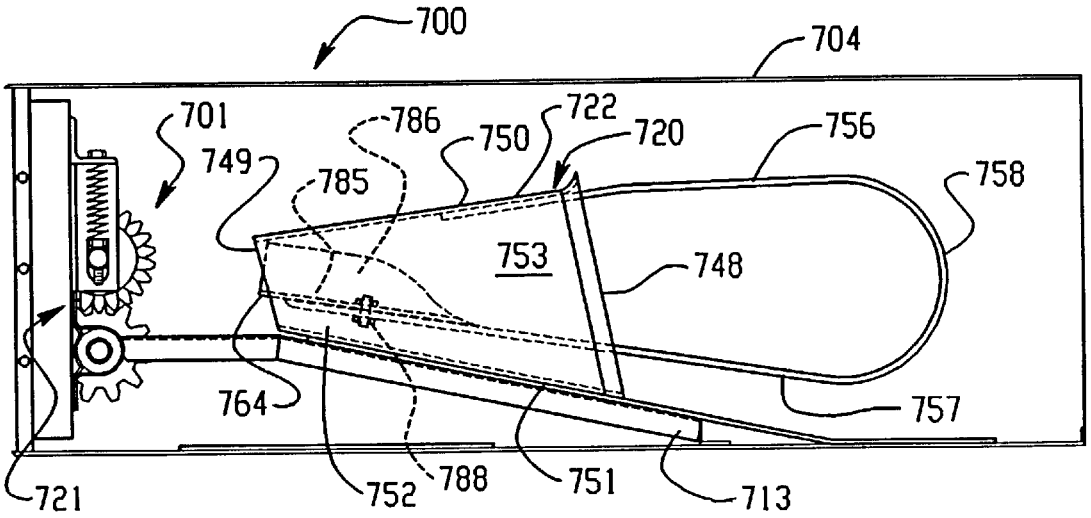

FIGS. 33 and 34 are schematic top and side views, respectively, of a cushioning conversion machine 700 according to the present invention, the machine being shown without stock material passing therethrough.

Figure 35A:
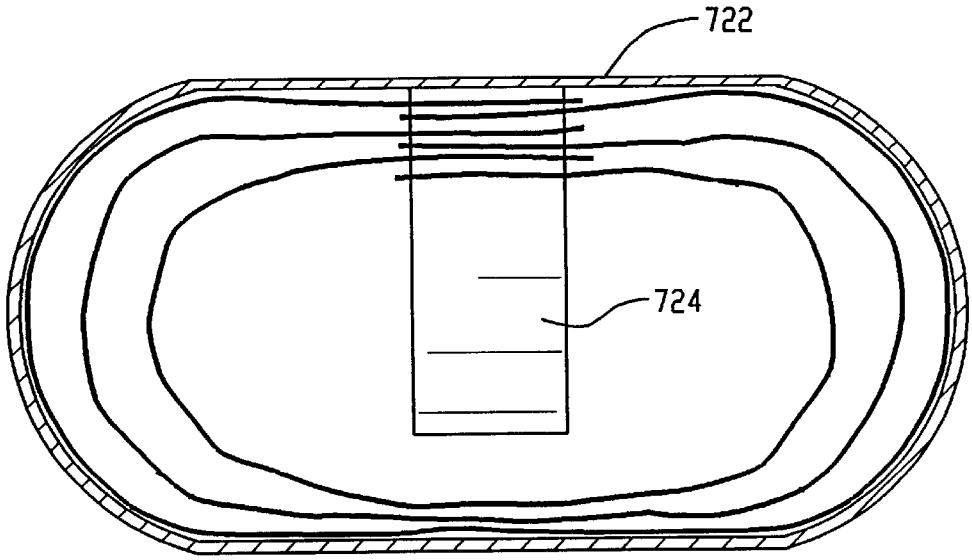
Figure 35B:
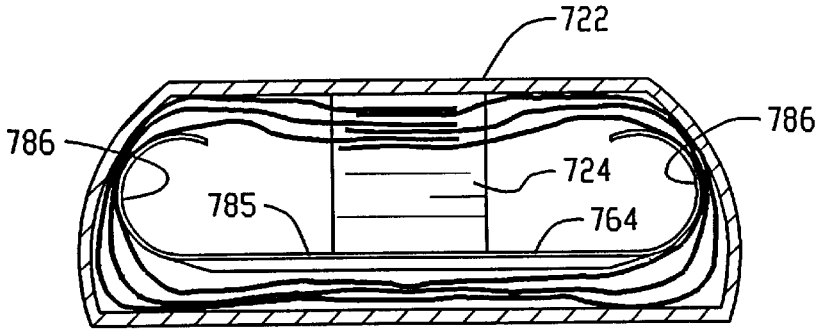
Figure 35C:
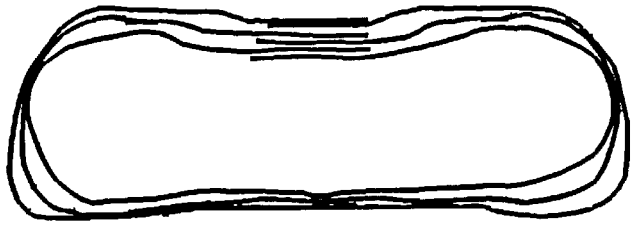

FIGS. 35A–35C are schematic cross-sectional views taken as indicated in FIG. 33, with stock material passing through the machine.

Figure 36:
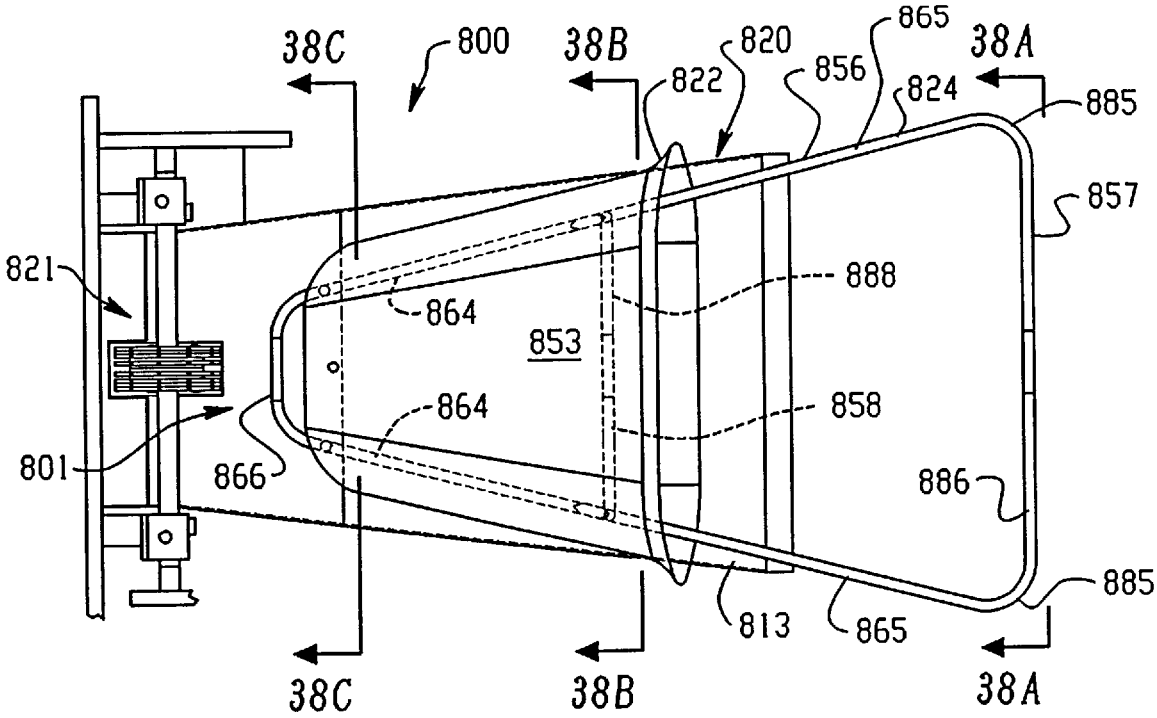
Figure 37:
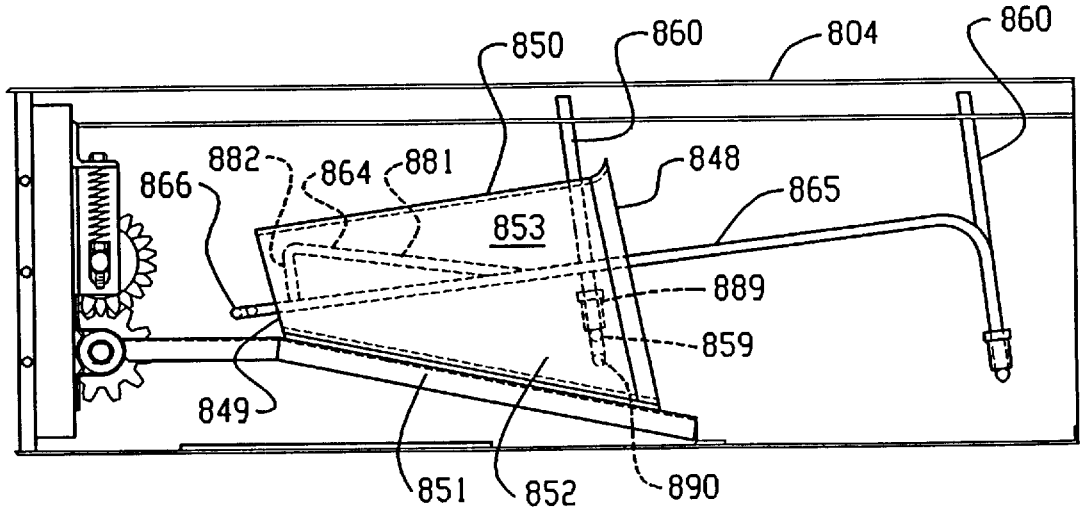

FIGS. 36 and 37 are schematic top and side views, respectively of a cushioning conversion machine 800 according to the present invention, the machine being shown without stock material passing therethrough.

Figure 38A:
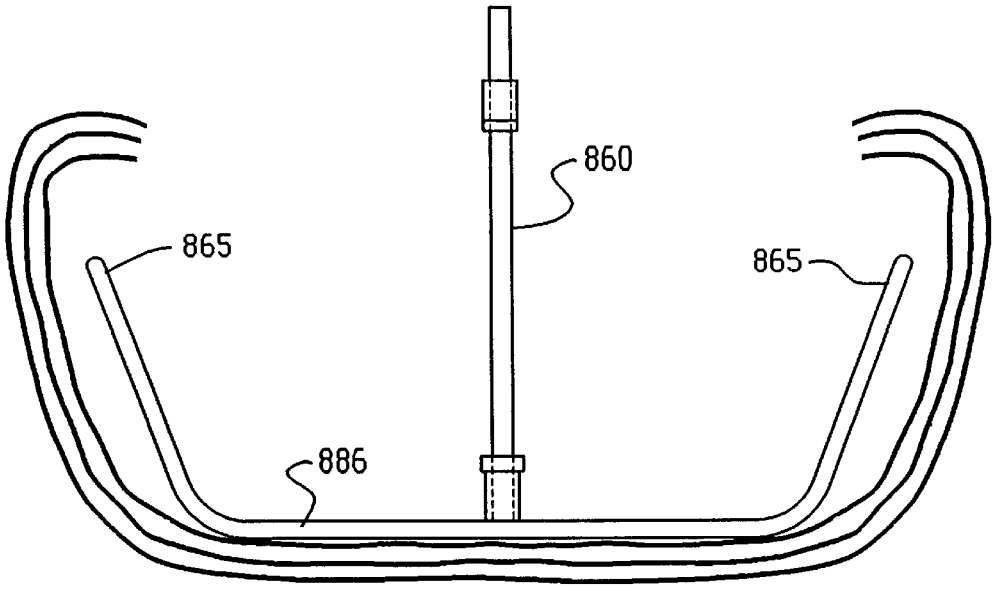
Figure 38B:
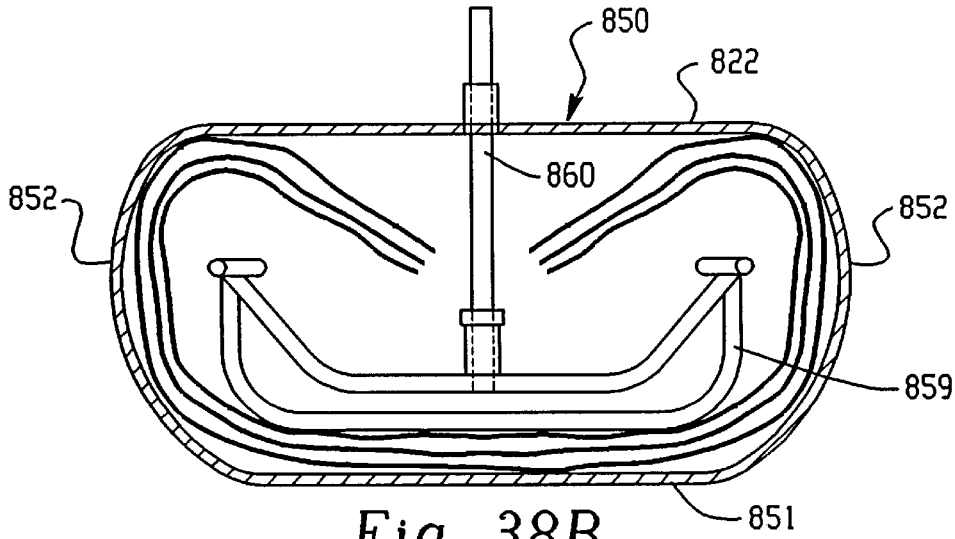
Figure 38C:
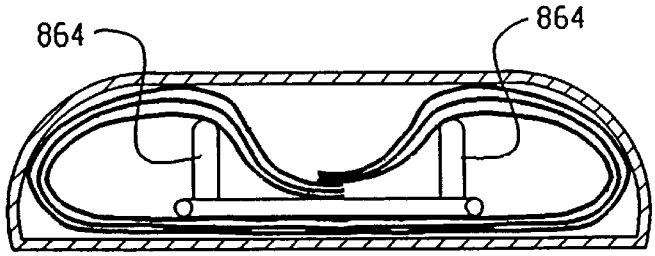

FIGS. 38A–38C are schematic cross-sectional views taken as indicated in FIG. 36, with stock material passing through the machine.

Figure 39:
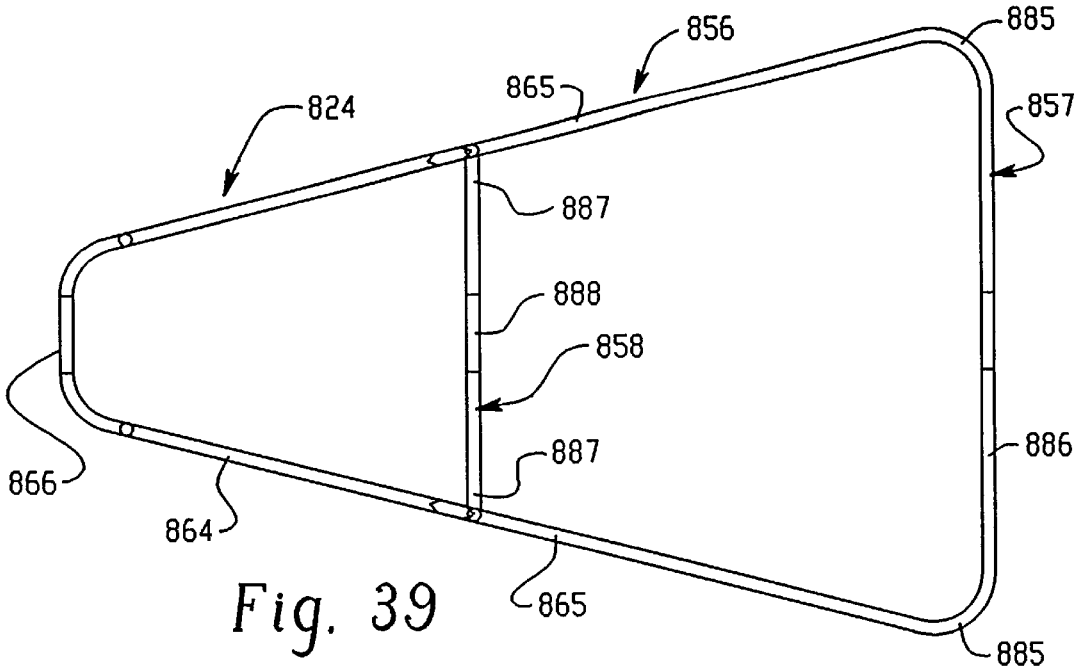
Figure 40:
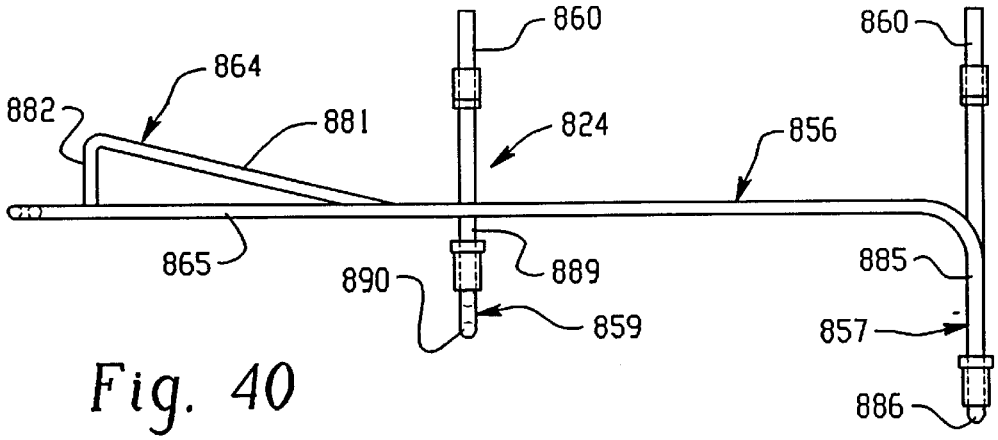
Figure 41:
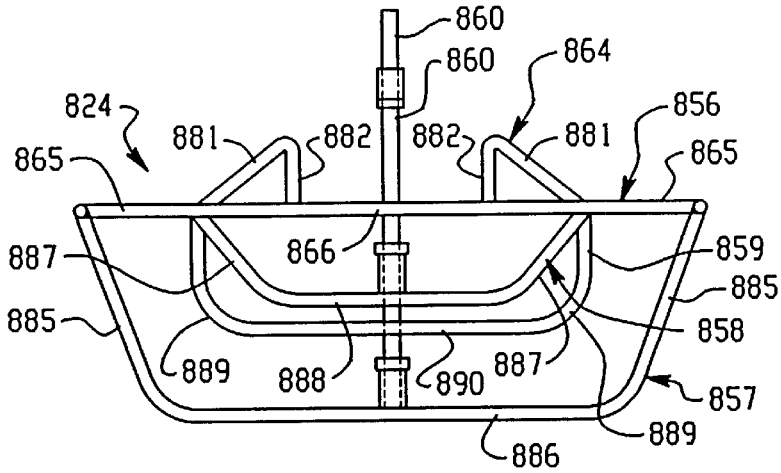

FIGS. 39, 40 and 41 are isolated top, side, and upstream end views, respectively of an internal forming device 824 used in the cushioning conversion machine 800.

Figure 42:
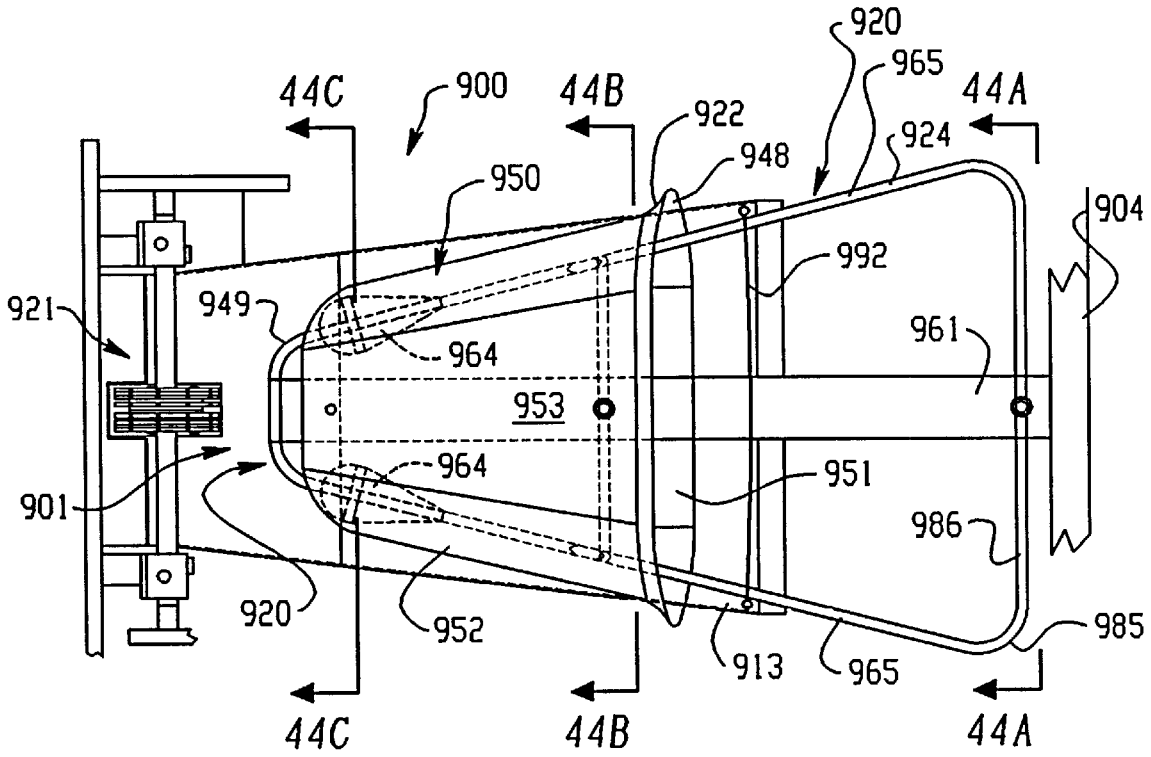
Figure 43:
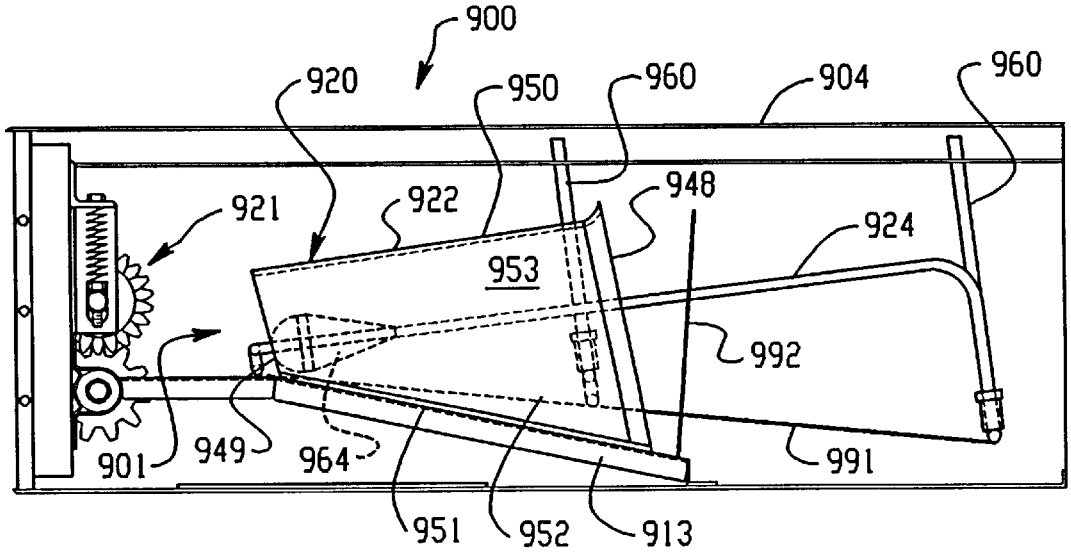

FIGS. 42 and 43 are schematic top and side views, respectively, of the cushioning conversion machine 900, the machine being shown without stock material passing therethrough.

Figure 44A:
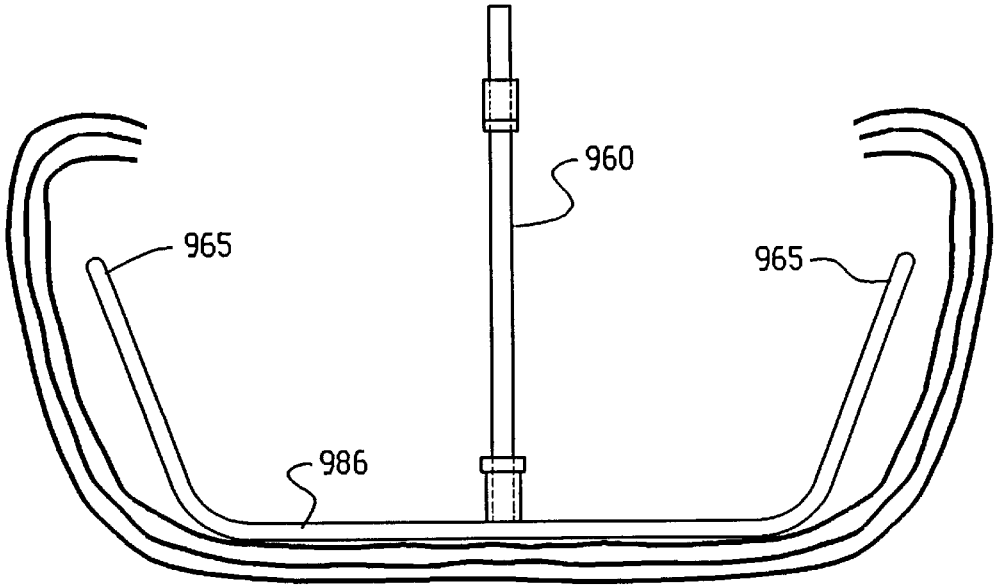
Figure 44B:
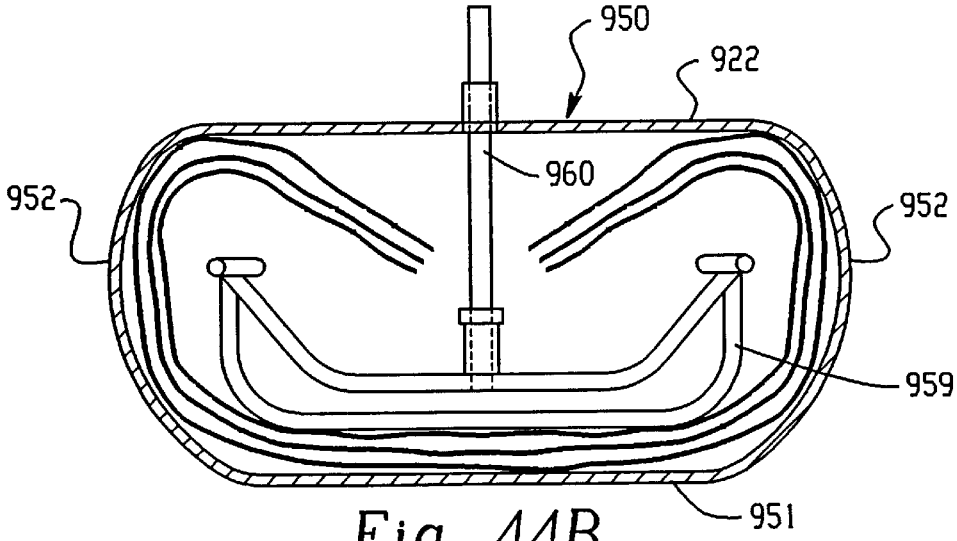
Figure 44C:
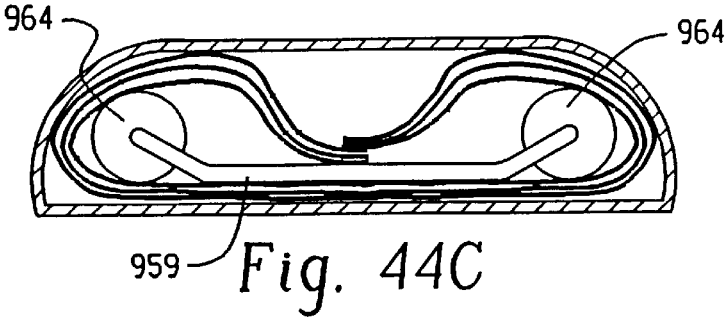

FIGS. 44A–44C are schematic cross-sectional views taken as indicated in FIG. 42, with stock material passing through the machine.

Figure 45:
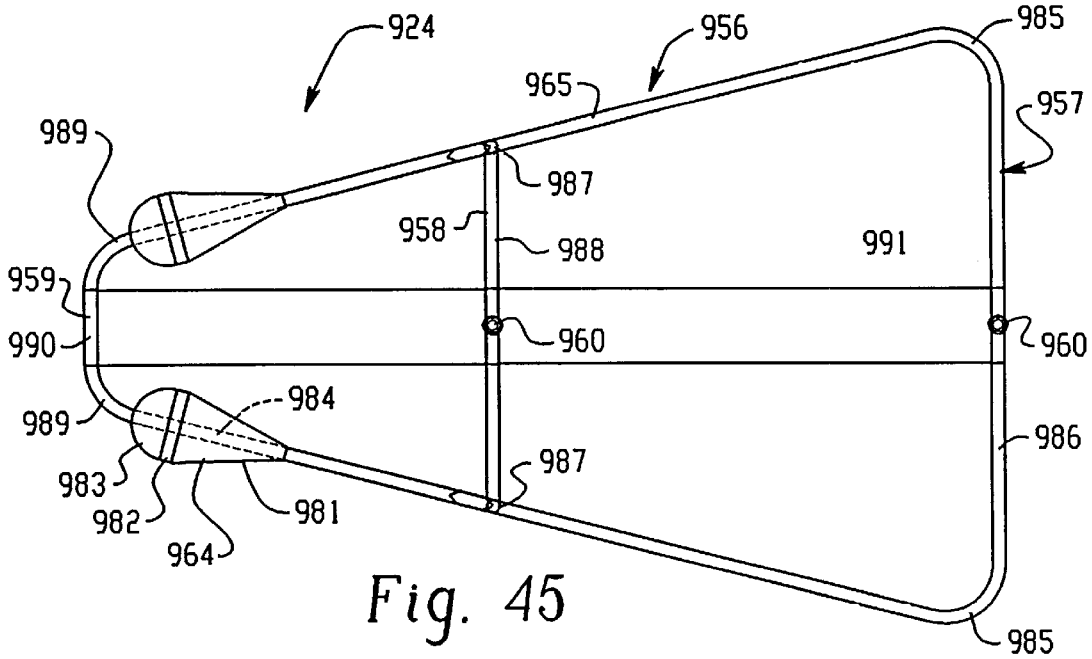
Figure 46:
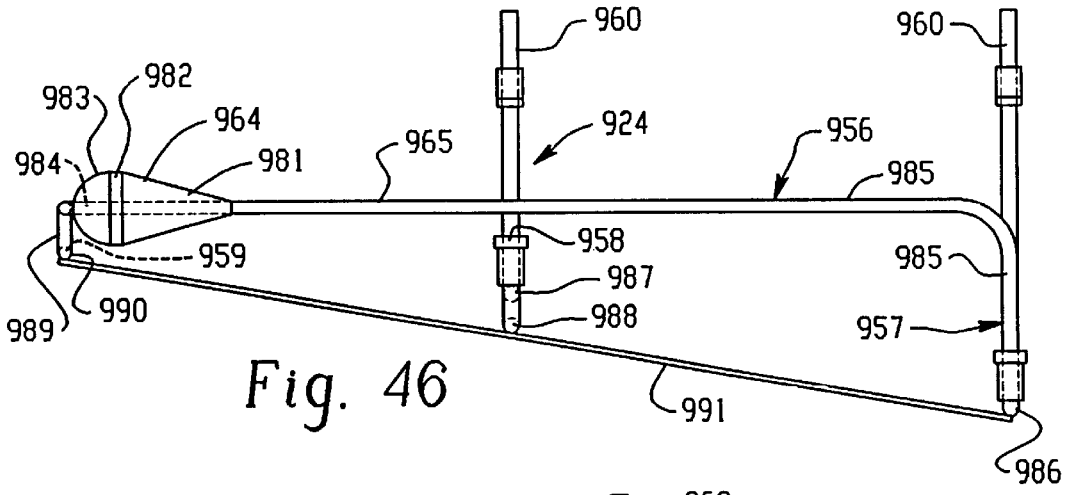
Figure 47:
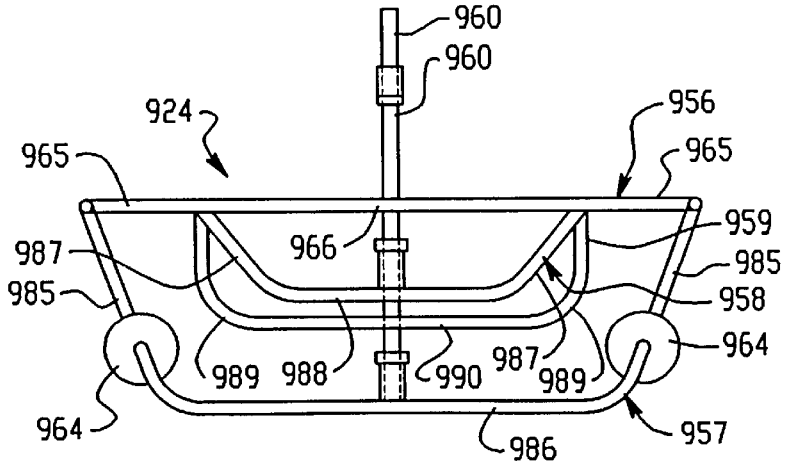

FIGS. 45–47 are isolated top, side and upstream end views, respectively, of an internal forming device 925 of the cushioning conversion machine 900.

DETAILED DESCRIPTION

Referring now to the drawings in detail, cushioning conversion machines 100, 200, 300, 400, 500, 600, 700 and 800 according to the present invention are shown. These cushioning conversion machines convert a sheet-like stock material having a prescribed width into three-dimensional cushioning products. The preferred stock material is a roll of two or three superimposed webs or layers of biodegradable, recyclable and reusable thirty-pound or fifty-pound Kraft paper. The roll is, for example, 28 to 30 inches wide and approximately 450 feet long.

The cushioning conversion machines each form the stock material into a strip. The strip has at least one pillow-like portion and a portion which is connected to maintain the geometry of the pillow-like portion. The preferred strip has two lateral pillow-like portions disposed in lateral abutting relationship on opposite sides of a central portion or band.

The strip is then connected (such as by compression, perforations, and/or slitting) along its central band to produce a strip of cushioning. Thus, the preferred cushioning strip preferably has two lateral pillow-like portions and a compressed (when compared to the lateral pillow-like portions) central portion or band in which overlapped portions of the stock material are connected together.

In any event, the cushioning strip may be cut into sections or pads of desired length that may be used instead of conventional plastic protective packaging material. The preferred cushioning conversion machines will convert the preferred roll of stock material into cushioning pads equal to approximately four 15 $ft^3$ bags of plastic foam peanuts while at the same time requiring less than 1/30th the storage space.

In the following subsections, the cushioning conversion machines 100, 200, 300, 400, 500, 600, 700 and 800 are each described. Except where noted, the detailed description of the overall construction and operation of the cushioning conversion machine 100 will likewise apply to the other cushioning conversion machines. Moreover, the principles of the present invention may be used with any cushioning conversion machine or method which falls within the scope of the claims.

In the following subsections (and in the context of the present invention), the upstream-downstream direction and/or the longitudinal dimension corresponds to the flow of stock material through the cushioning conversion machine. The traverse dimensions correspond to the vertical and horizontal planes passing through the longitudinal axis of the cushioning conversion machine when this longitudinal axis is horizontally oriented. More specifically, the lateral transverse dimension refers to the horizontal plane or "width" of the cushioning conversion machine (top-to-bottom in FIGS. 1, 8, 18, 21, 24, 27, 30, 33, and 36) and the non-lateral transverse dimension refers to the vertical plane or "height" of the cushioning conversion machine (top-to-bottom in FIGS. 2, 9, 19, 22, 25, 28, 31, 34, and 37). Certain directional modifiers may be used during the description of the cushioning conversion machines, such as upper, lower, upwardly, top, bottom, etc., these terms corresponding to the illustrated orientation. Any directional modifiers are used solely for convenience, they do not in any way limit the invention to a particular orientation of the cushioning conversion machine.

Cushioning Conversion Machine 100

Figure 1:
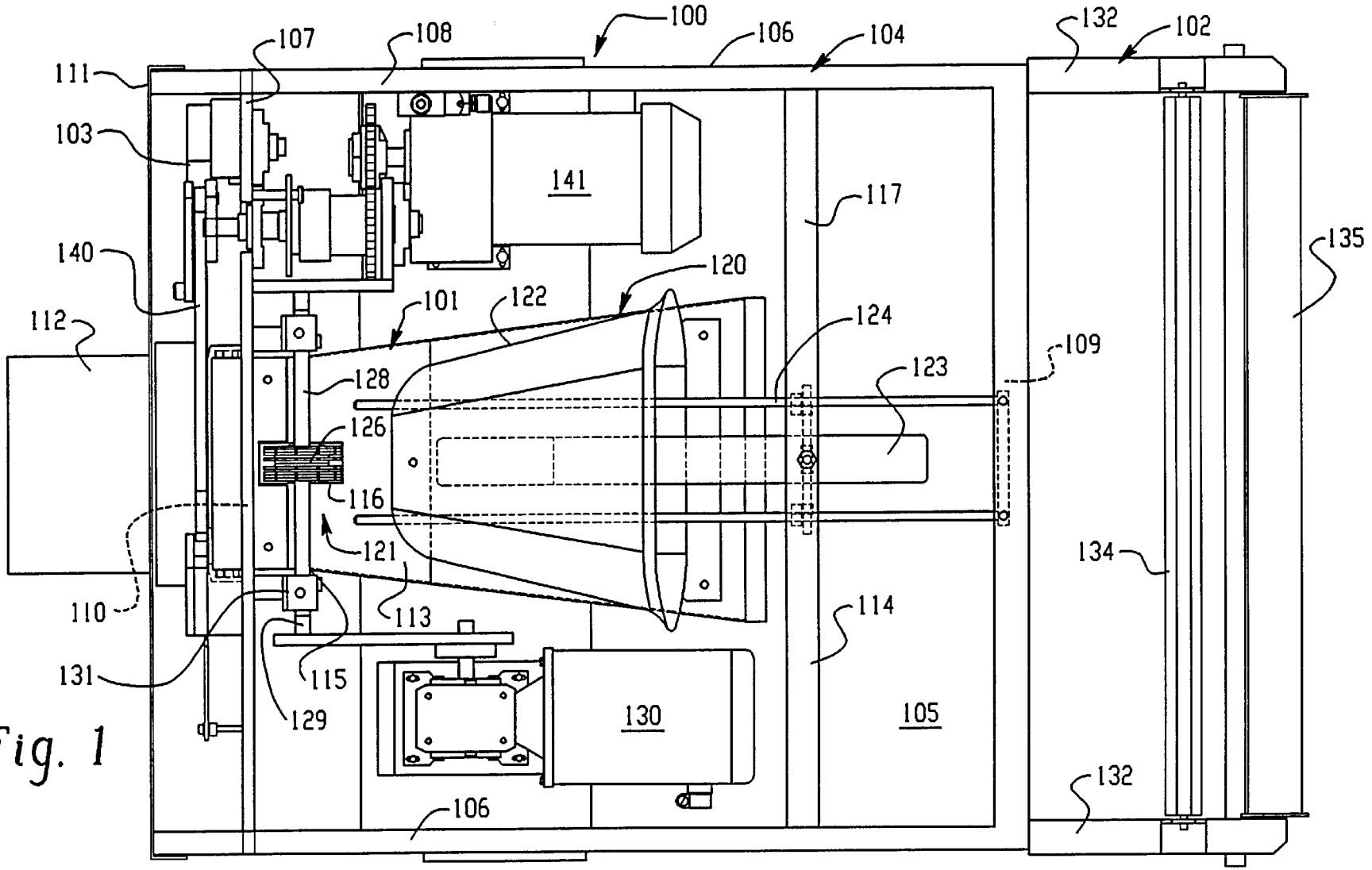
Figure 2:
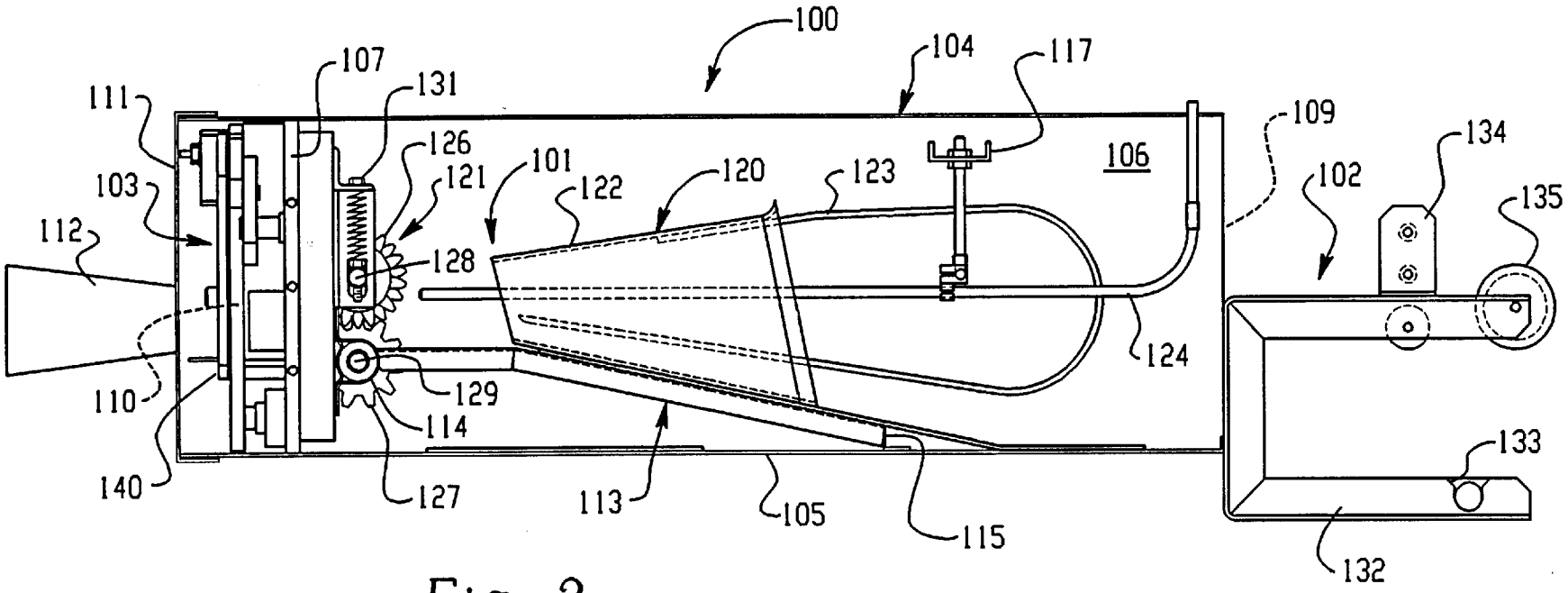

Referring now to FIGS. 1 and 2, the cushioning conversion machine 100 is shown. The cushioning conversion machine 100 includes a conversion assembly 101 which converts the stock material into the strip of cushioning, a stock supply assembly 102 which supplies the stock material to the conversion assembly 101, and a severing assembly 103 which cuts the strip of cushioning into sections or pads of a desired length.

The cushioning conversion machine 100 further comprises a housing 104 which at least partially encloses the conversion assembly 101. In the illustrated embodiment, the housing 104 includes a bottom wall 105, lateral side walls 106, and a downstream end wall 107 with the walls 105–107 together defining a rectangular envelope. The upper edges of these walls, or alternatively a separate piece of material, form a rectangular border 108 around the top of the rectangular envelope. Although not shown in the drawings, the machine's housing 104 includes a top wall or cover to enclose the rectangular envelope.

The upstream edges of the walls 105 and 106 cooperate to define a stock inlet 109 and the downstream end wall 107 has a rectangular opening defining a strip outlet 110. The machine housing 104 preferably also includes a box-like extension 111 attached to the downstream end wall 107 and a post-cutting tunnel 112 extending downstream from the extension 111. As is explained in more detail below, the strip of cushioning produced by the machine 100 is of a different cross-sectional geometry than the cushioning strips produced by earlier machines. Accordingly, the area of the strip outlet 110 and/or the transverse dimensions of the tunnel 112, may need to be different (i.e., larger) than those in earlier machines to adequately accommodate the cross-sectional geometry of the cushioning strip.

The conversion assembly 101 is mounted within the rectangular envelope defined by the housing walls 105–107. The stock supply assembly 102 is mounted to an upstream end of the housing 104. The "severing components" of the severing assembly 103 are mounted to a downstream side of the end wall 107. The stock material travels from the stock supply assembly 102, through the stock inlet 109 into the rectangular envelope whereat it is converted into the strip of cushioning by the conversion assembly 101. The strip of cushioning then passes through the strip outlet 110 in the end wall 107 and into the extension 111 whereat it is cut into sections or pads which travel downstream through the post-cutting tunnel 112.

The housing 104 also includes a guide tray 113 positioned within the noted rectangular envelope and directly mounted to the bottom wall 105. When viewed from the side, the guide tray 113 is not positioned parallel with the bottom wall 105, but rather slopes upwardly from the wall 105 in the downstream direction. (FIG. 2.) When viewed in plan, the guide tray 113 is trapezoidal in shape having a wide upstream edge 114 and a parallel narrow downstream edge 115. (FIG. 1.) The narrow edge 115 is positioned adjacent the strip outlet 110 in the housing end wall 107. The guide tray 113 includes a laterally centrally located slot 116 in a downstream region which is sized and positioned to accommodate a component of the conversion assembly 101, namely a rotating feed member 127 introduced below.

The housing 104 may further comprise a cross-strap 117 that extends laterally between the side walls 106 and/or the rectangular border 108. The cross-strap 117 is longitudinally positioned so that it extends across an upstream region of the rectangular envelope formed by the housing walls 105–107. More particularly, the cross-strap 117 is longitudinally positioned upstream of a certain device of the conversion assembly 101, namely an external forming device 122, introduced below.

The conversion assembly 101 comprises a forming assembly 120 and a feeding assembly 121. The forming assembly 120 includes an external forming device 122, an internal forming device 123 and another internal forming device 124, which are described in detail below. The forming devices 122–124 are preferably all positioned within a common envelope defined by the machine housing 104, specifically the rectangular envelope defined by the housing walls 105–107. The devices 122–124 are positioned within this envelope so that the stock material travels through the external forming device 122 and around the internal forming devices 123 and 124 to form the strip of stock material.

The strip of stock material travels from the forming assembly 120 to the feeding assembly 121 on the tray 113. The preferred feeding assembly 121 performs the dual function of pulling the stock material from the stock supply assembly 102 through the forming assembly 120 and connecting the overlapped edges of the stock material in the strip to maintain the strip's three-dimensional shape. In the illustrated embodiment, these dual functions are carried out by a pair of rotating feed members 126 and 127. Preferably, the rotating feed members 126 and 127 are of the type disclosed in PCT International Publication No. WO 96/40493 and cooperate to form a row of tabs for interlocking the overlapped portions of the stock material. (The invention disclosed in this PCT publication is assigned to the assignee of the present application and the entire disclosure of the publication is hereby incorporated by reference.)

The upper feed member 126 is rotatably mounted on a spring-biased shaft 128 and the lower feed member is fixedly mounted on a shaft 129 driven by a feed motor 130. The lower shaft 129 is positioned below the guide tray 113 and the upper region of the lower feed member 127 projects through the tray's slot 116. Thus, the lateral pillow-like portions of the strip of stock material travel over the tray 113 and under the shaft 128. As was alluded to above, and as is explained in more detail below, the strip of stock material is of a different cross-sectional geometry than the cushioning strips produced by earlier machines. Accordingly, the non-lateral transverse (e.g., vertical) distance between the tray 113 and the upper shaft 128 should be adequate to accommodate the strip without crushing its pillow-like portions. This may require, for example, using rotating feed members with larger diameters so that the vertical position of the upper shaft 128 may be elevated relative to the tray 113.

The stock supply assembly 102 comprises two laterally spaced U-shaped brackets 132 mounted to an upstream end of the machine's housing 104. The bottom legs of the brackets 132 have open slots 133 for receipt of a supply rod which extends through the hollow core of a roll of the stock material. The top legs of the brackets 132 cooperate to mount a separating device 134 and a constant-entry roller 135 therebetween. The stock material travels from the stock roll, over the constant-entry roller 135 and through the separating device 134 to the conversion assembly 101. The separating device 134 includes separator members that separate the individual plies of the stock material. The constant-entry roller 135 maintains a constant point of entry for the stock material into the conversion assembly 101 regardless of the diameter of the stock roll due to, for example, depletion of stock material therefrom. Further details of a separating device and/or a constant entry roller are set forth in U.S. Pat. No. 4,750,896. (This patent is assigned to the assignee of the present invention and its entire disclosure is hereby incorporated by reference.)

The severing assembly 103 cuts the strip of cushioning into sections or pads of a desired length as the strip passes through the outlet 110. In the illustrated embodiment, the severing assembly 103 comprises a cutting device 140 which is powered by a cut motor 141. The cutting device 140 is mounted to the downstream'side of the housing end wall 107 within the housing extension 111 and the motor 141 is mounted to the bottom wall 105 of the machine's housing. Further details of a suitable severing assembly (or cutting assembly) are set forth in U.S. Pat. No. 5,123,889 and/or U.S. Pat. No. 5,569,146. (These patents are assigned to the assignee of the present invention and their entire disclosures are hereby incorporated by reference.) Turning now in detail to the forming assembly 120, as was indicated above, it includes the external forming device 122, the internal forming device 123, and another internal forming device 124. The external forming device 122 and the internal forming device 123 are shown in detail in FIGS. 3–5. A similar external forming device (called a "chute") and a similar internal forming device (called "a shaping member") are disclosed U.S. Pat. No. 5,607,383. (This patent is assigned to the assignee of the present application and its entire disclosure has already been incorporated by reference.)

The external forming device 122 has an inlet 148, an outlet 149, and surfaces 150–152 therebetween which define a turning space 153. The surfaces 150–152 radially restrict the stock material as it travels through the turning space 153 to form the strip of stock material which emerges from the outlet 149. Preferably, the external forming device 122 is a chute and the surfaces 150–152 are substantially continuous walls extending between the chute's inlet 148 and outlet 149. More particularly, the external forming device 122 is a converging chute whereby its inlet 148 is of a greater cross-sectional area than its outlet 149 and its walls 150–152 taper inwardly in the downstream direction. In this manner, the external forming device 122 defines a pathway for the stock material, this pathway having in traverse cross-section a central laterally extending region bounded by inwardly turning regions therearound and which come together at least at the outlet 149 of the external forming device 122.

The continuous walls 150–152 of the preferred external forming device 122 include a top wall 150, a bottom wall 151 and side walls 152. The bottom wall 151 is secured to the guide tray 113 via suitable fasteners to mount the external forming device 122 to the machine's housing 104. (FIG. 1.) The walls 150–152 are preferably formed in one piece from a suitable material such as, for example, plastic or fiber glass. The walls 150–152 are additionally or alternatively preferably transparent to facilitate internal viewing as might be desirable when, for example, threading the stock material through the forming assembly 120.

Figure 5:
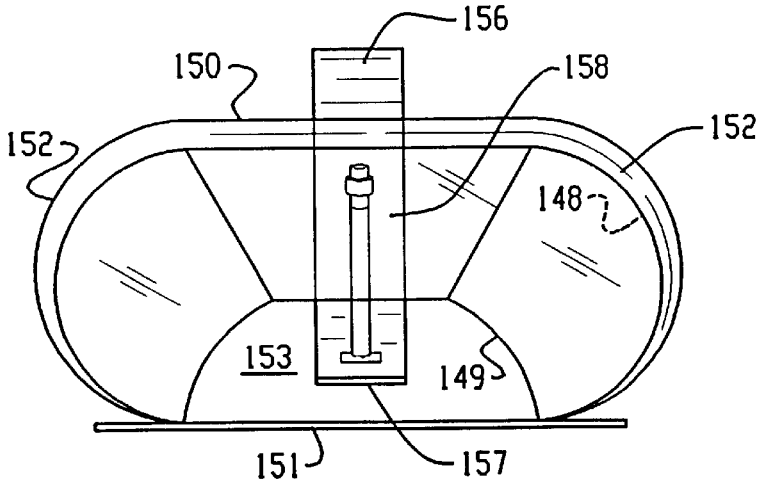

The top wall 150 is of a generally flat trapezoidal shape, the bottom wall 151 is of a generally flat rectangular shape, and the side walls 152 are of a generally arcuate shape. The upstream edges of the walls 150–152 define the inlet 148 which has a widened generally oval-shaped configuration. (See FIG. 5). Preferably, the upstream edges of the top wall 150 and the side walls 152 are outwardly flared in a trumpet-like fashion to facilitate the passage of the stock material into the turning space 153 and/or to prevent any tears in the stock material during this passage. The downstream edges of the walls 150–152 define the outlet 149 which has a generally semi-oval configuration, the half oval being taken along the oval's major (as opposed to minor) axis. (FIG. 5.)

While the preferred external forming device 122 is a converging chute, other external forming devices are possible with and contemplated by the present invention. For example, a non-converging chute may be a suitable external forming device in certain situations. Alternatively, a turning space defined by a series of longitudinally separated hoops may also constitute an external forming device. Another option is an external forming device in which flat walls and/or bars are used to externally restrict the stock material. In fact, any structure or device which externally acts on the stock material during the formation of a strip of stock material may be considered an external forming device for the purposes of the present invention. That being said, the term "chute" will be used interchangeably with the term "external forming device" in the remaining description, only because a chute is the preferred external forming device.

Figure 3:
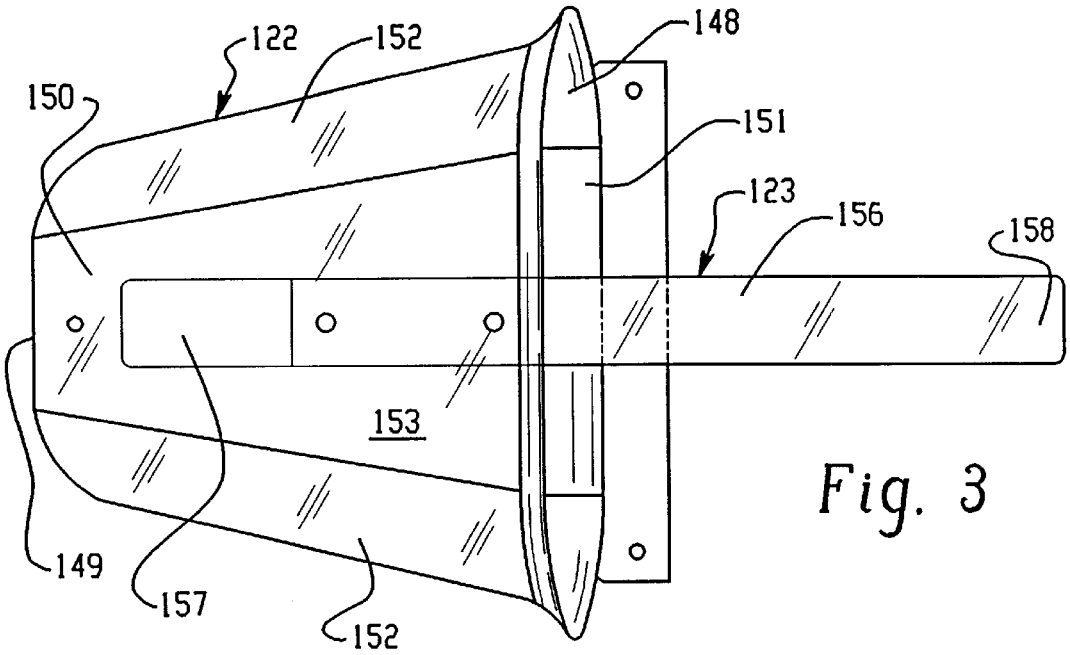
Figure 4:
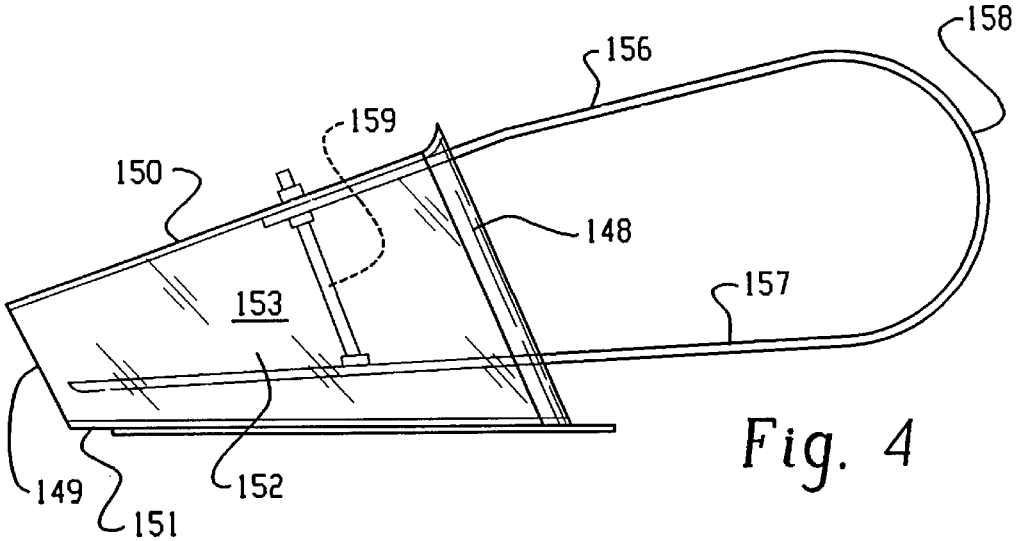

The internal forming device 123 includes an upper leg portion 156, a lower leg portion 157 and a bight portion 158. (FIGS. 3–5.) The portions 156–158 are generally of the same width and joined together in a pinched U-shape that generally corresponds in appearance to a bobby pin. (FIGS. 3 and 4.) The upper leg portion 156 and the lower leg portion 157 are generally straight and converge towards one another. The bight portion 158 is rounded (i.e., it has a semi-circular shape when viewed from the side) and functions as a living hinge between the leg portions 156 and 157. (FIGS. 3 and 4.) To this end, the forming device 123 is preferably made of a material, such as plastic, which has sufficient flexibility to allow the bight portion 158 to function as a hinge.

In relation to the external forming device 122, the upstream regions of the internal forming device 123 are positioned upstream of the chute's inlet 148, preferably by approximately one-half the overall length of the device 123. (FIGS. 3 and 4.) Thus, the entire bight portion 158 of the internal forming device 123 is positioned entirely upstream of the chute's inlet 148. The radius of the bight portion 158 is preferably approximately one-half the height of the chute's inlet 148 as this dimensional relationship is believed to provide a smooth transition for the stock material from the separating device 134 into the forming assembly 120.

The upper leg portion 156 (or more specifically a downstream section thereof) is attached to the top wall 150 of the external forming device 122 along a laterally center line thereof. (FIGS. 4 and 5.) The lower leg portion 157 extends from the bight portion 158 into the turning space 153 of the external forming device 122. The downstream end of the lower leg portion 157 is positioned at a point approximately coterminous with the chute's outlet 149. (FIGS. 3 and 4.) The lower leg portion 157 is preferably positioned parallel to the bottom wall 151 of the external forming device 122. (FIGS. 4 and 5.) The relative inclination and/or spacing between the lower leg portion 157 and the chute's bottom wall 151 may be varied with an adjustment member 159.

Thus, the internal forming device 123 is positioned at least partially within the turning space 153 of the external forming device 122 and coacts therewith during the inward turning of lateral regions of the stock material to form the strip of stock material. Specifically, the bottom surface of the lower leg portion 157 defines a holding surface which holds the central region of the stock material as its lateral regions are inwardly turned in the turning space 153. More specifically, the lower leg 157 holds the central region of the stock material at a predetermined distance from the chute's bottom wall 151 which is different than the distance that the stock material would pass in the absence of the lower leg portion 157.

While the preferred internal forming device 123 has the above-described pinched bobby-pin shape, other internal forming devices are possible with, and contemplated by, the present invention. For example, the forming assembly 120 could include the one of the internal forming devices disclosed in U.S. Pat. Nos. 4,026,298; 4,085,662; 4,109,040, 4,237,776; 4,717,613; 4,750,896; 4,884,999; 5,061,543; and 5,188,581. In fact, any internal forming device which the stock material travels around as it passes through the turning space of an external forming device may be appropriate in certain situations. Moreover, a forming assembly in which an external forming device does not coact with an internal forming device to form a strip of stock material may be possible with, and is contemplated by, the present invention.

Figure 6:
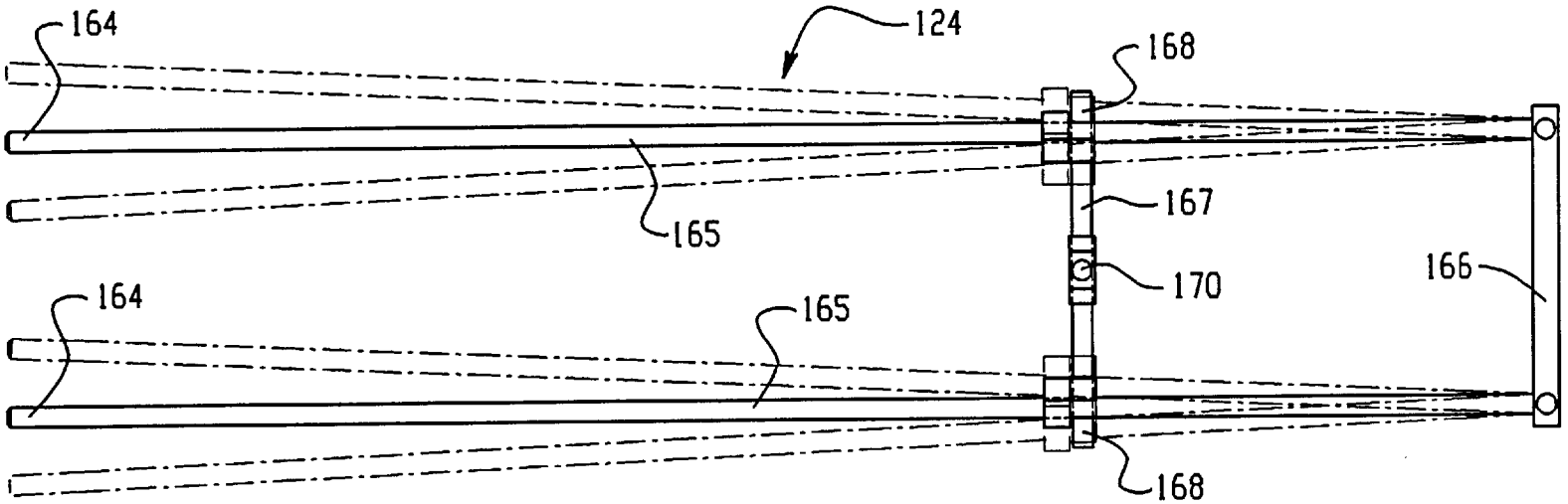
Figure 7:
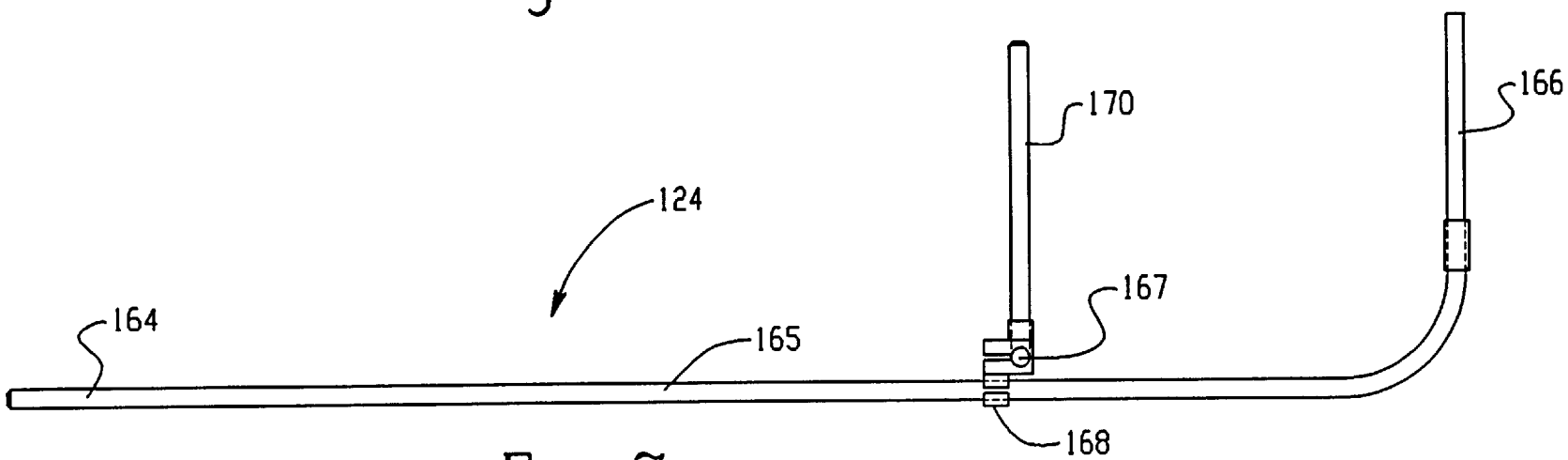

The internal forming device 124 of the cushioning conversion machine 100 is shown in detail in FIGS. 6 and 7. The internal forming device 124 comprises a pair of interacting portions 164, a pair of supporting portions 165, a pair of mounting portions 166, a brace portion 167, and a bridge portion 168. The portions 165–168 coordinate to position the interacting portions 164 in the correct spatial location relative to the external forming device 122. Specifically, the interacting portions 164 are positioned downstream of the chute's outlet 149, are symmetrically situated relative to the lateral center of the turning space 153 and are longitudinally aligned with the chute's inlet 148 and outlet 149 (in other words, the strip of stock material does not have to turn any corners as it travels between the chute's outlet 149 to the interacting portions 164). As is explained in more detail below, the interacting portions 164 function to re-shape the cross-sectional geometry of the strip after it emerges from the outlet 149 of the external forming device 122.

In the internal forming device 124, the supporting portions 165 are generally straight rod-like members and the interacting portions 164 comprise the downstream ends of these rod like members. (FIGS. 6 and 7.) The mounting portions 166 are also straight rod-like members, each having a bottom end attached to an upstream end of the one of the supporting portions 165 and extending upwardly therefrom. (FIGS. 6 and 7.) The top ends of the mounting portions 166 are pivotally attached to an upstream portion of the machine's housing 104, such as a section of the rectangular border 108 located above the stock inlet 109. (FIGS. 1 and 2.) Thus, the supporting portions 165 each longitudinally extend from a position upstream of the chute's inlet 148, through the turning space 153, to a position downstream of the chute's outlet 149. The brace portion 167 is a bar-like member which extends between a laterally aligned intermediate section of the supporting portions 165 and acts as a stabilizer for these portions.

The bridge portion 168 is a straight rod-like member extending laterally between the supporting portions 165 and its opposite ends are attached thereto by couplings 169. (FIG. 6.) The bridge portion 168 is mounted to the machine's housing 104, and more particularly the cross-strap 117, via a suspension strap 170. The lower end of the suspension strap 170 is attached to the lateral center of the bridge portion 168 and the strap 170 extends upwardly therefrom. (FIG. 7.) The upper end of the suspension strap 170 is attached to the cross-strap 117, preferably in such a manner that the suspension strap 170 is vertically adjustable relative to the machine's housing 104. (FIG. 2.) In this manner, the supporting portions 165 are mounted to the machine housing 104 upstream of the chute's inlet 148.

Preferably, the bridge couplings 169 allow at least limited pivoting of the supporting portions 165, whereby the interacting portions 164, may be selectively adjusted. Specifically, the supporting portions 165 would be inwardly or outwardly pivoted to change the lateral distance therebetween. (FIG. 6, showing in phantom the supporting portions 165 inwardly and outwardly pivoted.) In this manner, the interacting portions 164 are laterally adjustable relative to the chute's outlet 149.

The connecting portions 166 may be secured to the machine housing 104 in such a manner that limited longitudinal movement is selectively possible. (For example, the mounting region of the housing 104 could include slots and/or a series of apertures.) If so, the longitudinal positioning of the supporting portions 165, and thus the interacting portions 164, may be selectively adjusted. In this manner, the interacting portions 164 will be longitudinally adjustable relative to the chute's outlet 149.

Figure 8:
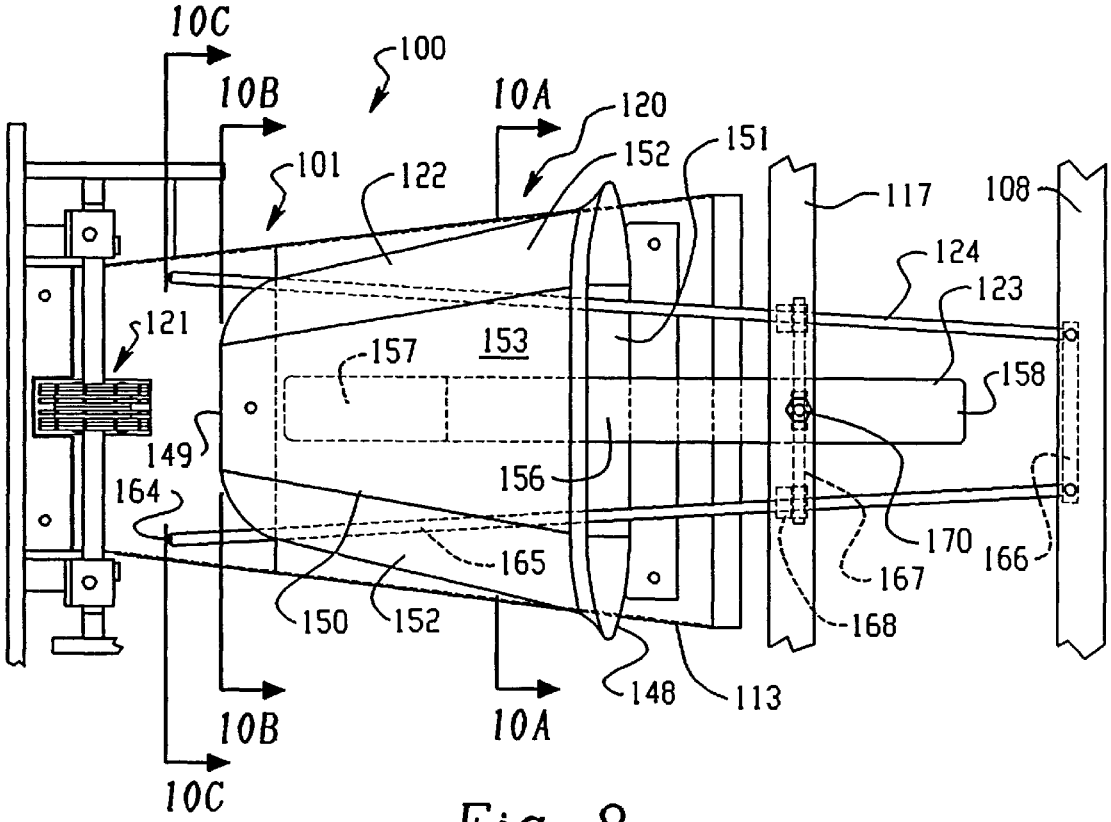
FIGS. 8 and 9 are schematic top and side views, respectively, of the cushioning conversion machine 100, the machine being shown without stock material passing therethrough.
Figure 9:
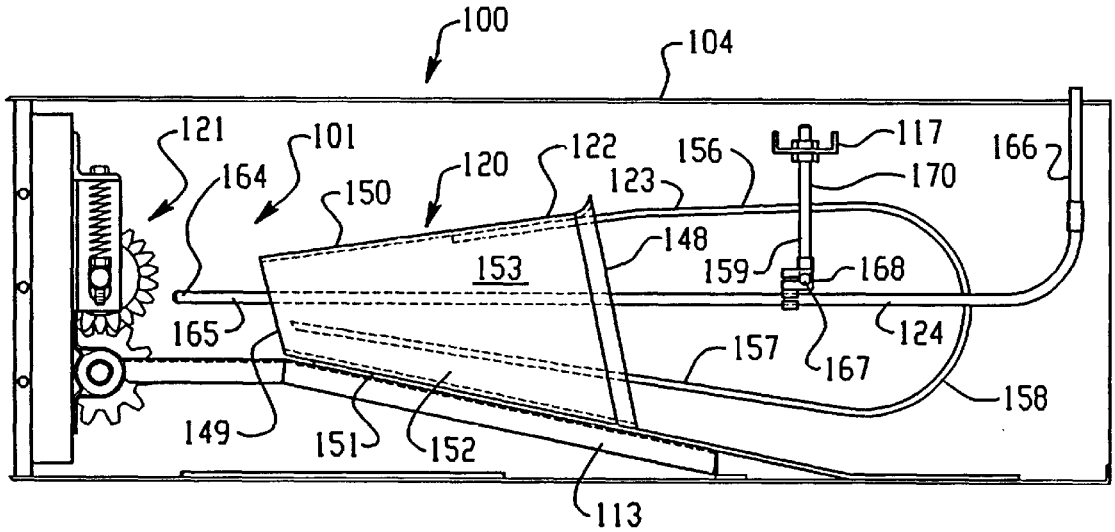
Figure 10A:
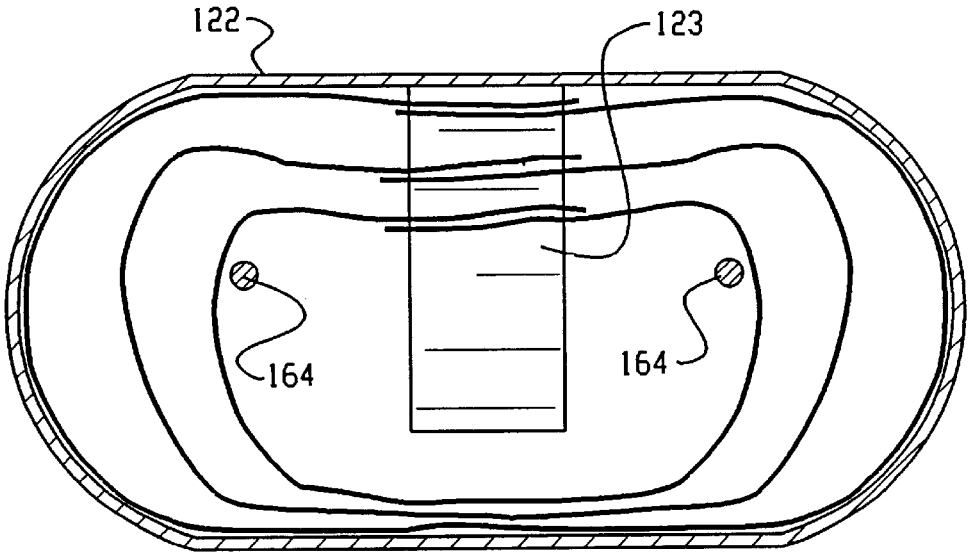
FIGS. 10A–10C are schematic cross-sectional views taken as indicated in FIG. 8, with stock material passing through the machine.
Figure 10B:
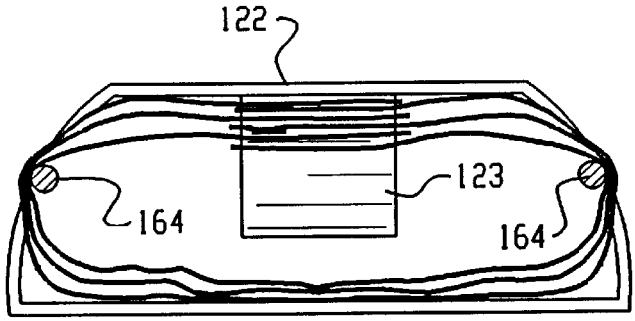
Figure 10C:
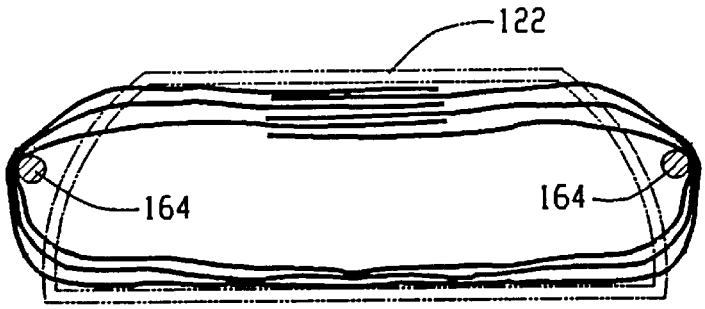

Turning now to FIGS. 8–10, the cushioning conversion machine 100 is schematically shown in FIGS. 8 and 9, and the conversion of the stock material as it passes through the machine 100 is schematically shown in FIGS. 10A–10C.

As was explained above, the surfaces 150–152 of the external forming device 122 radially restrict the stock material as it travels through the turning space 153 to cause inward turning of the lateral regions of the stock material. (FIG. 10A.) In the preferred and illustrated cushioning conversion machine 100, the internal forming device 123 coacts with the chute 122 to cause this inward turning. In any case, the strip of stock material emerges from the chute's outlet 149 having a certain cross-sectional geometry. (FIG. 10B.) Downstream of the chute's outlet 149, the interacting portions 164 of the internal forming device 124 internally re-shape the strip so that it has a different cross-sectional geometry. (FIG. 10C.) In the internal forming device 124, the interacting portions 164 are shaped to increase the lateral dimension of the cross-sectional geometry of the strip.

Figure 11A:
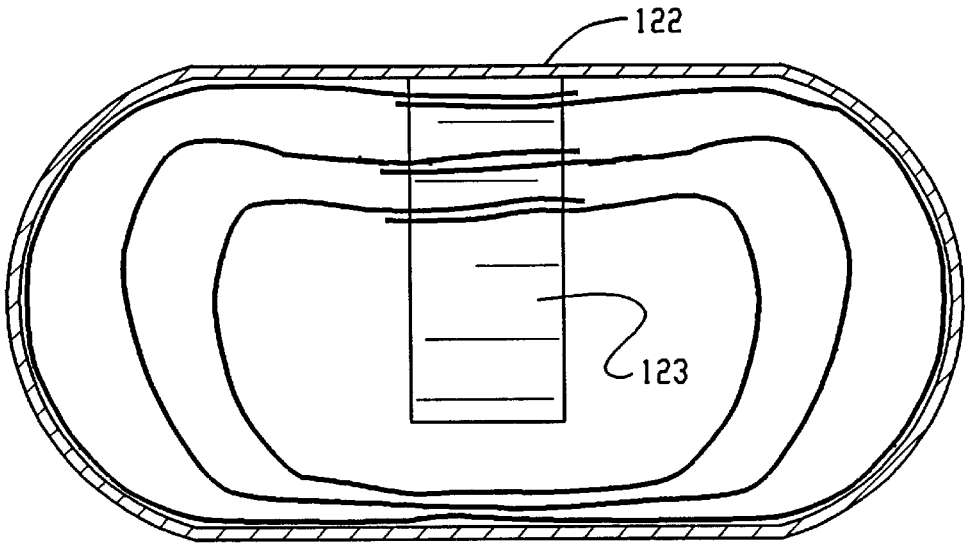
FIGS. 11A–11C are schematic cross-sectional views similar to FIGS. 10A–10C, except they are taken in a cushioning conversion machine without an internal forming device 124.
Figure 11B:
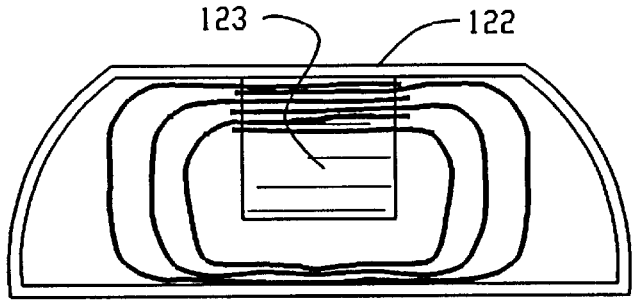
Figure 11C:
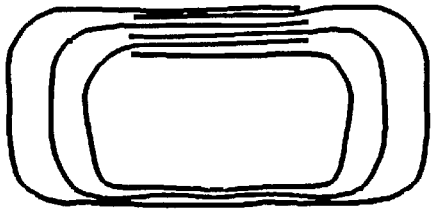

By way of comparison, in a cushioning conversion machine without the internal forming device 124, the surfaces 150–152 of the external forming device 122 would still radially restrict the stock material as it travels through the turning space to cause inward turning of the lateral regions of the stock material. (FIG. 11A.) The strip of stock material would emerge from the chute's outlet 149 having a certain cross-sectional geometry. (FIG. 11B.) Downstream of the chute's outlet 149, there would be no internal re-shaping of the strip of stock material. (FIG. 11C.)

Referring now to FIGS. 12–17, the cushioning conversion machine 100 may incorporate an extruding device 190 and/or an extruding device 194. The extruding device 190 comprises a pair of extruding members 191 and a support structure 192 for supporting the extruding members. (FIGS. 12 and 13.) The extruding members 191 are longitudinally positioned downstream of the chute's outlet 149 and are transversely positioned to contact lateral sides of the strip of stock material. Preferably, the support structure 192 allows for lateral adjustment of the extruding members 191 whereby extruder's external re-shaping the cross-sectional geometry of the strip of stock material may be selectively varied. Exemplary forms of such an extruding device (called "pad adjustment devices") are disclosed in detail in International Application No. PCT/US98/04655. (This application is assigned to the assignee of the present application and its entire disclosure is hereby incorporated by reference.)

The extruding device 194 may be used in combination with the extruding device 190 or, as shown, may be used without the extruding device 190. (FIGS. 15 and 16.) In the illustrated embodiment, the extruding device 194 includes an extruding member 195 and a support structure 196 which supports the extruding member 195. The extruding member 195 is longitudinally positioned downstream of the chute's outlet 149 and transversely positioned to contact the top side of the funneled strip. Preferably, the support structure 196 allows for adjustment of the extruding member 195 towards and away from the tray 113 whereby the extruder's external re-shaping of the cross-sectional geometry of the strip may be selectively varied. If the tray 113 or another bottom surface is not present in the cushioning conversion machine, another lower extruding member may be used in conjunction with the upper extruding member 195.

In the cushioning conversion machine 100 incorporating the extruding device 190 or the extruding device 194, the lateral regions of the stock material are inwardly turned in the turning space 153 (FIGS. 14A and 17A) and the funneled strip emerges from the chute's outlet 149 (FIGS. 14B and 17B) in much the same manner as discussed above. However, downstream of the chute's outlet 149, the extruding members 191 or 195 coact with the interacting portions 164 of the internal forming device 124 externally re-shape the cross-sectional geometry of the strip. (FIGS. 14C and 17C.) Specifically, the extruding device 190 and/or 194 externally extrudes the outer configuration of the strip of stock material while the interacting portions 164 internally mold the inner configuration of the strip.

Cushioning Conversion Machine 200

Referring now to FIGS. 18–20, the cushioning conversion machine 200 is schematically shown in FIGS. 18 and 19, and the formation of the stock material as it passes through the machine 200 is shown in FIGS. 20A–20C.

The machine 200 comprises a conversion assembly 201 (including a forming assembly 220 and a feeding assembly 221) which converts the stock material into the three-dimensional strip of cushioning. Except for its forming assembly 220, the machine 200 may of the same construction as the cushioning conversion machine 100. Additionally, the machine 200 may incorporate the extruding device 190 and/or the extruding device 194.

The forming assembly 220 comprises an external forming device 222, an internal forming device 223 and another internal forming device 224 which are preferably positioned within a common envelope defined by the machine housing 204. The external forming device 222 may be the same as the external forming device 122 (e.g., a converging chute) having an inlet 248, an outlet 249, and surfaces 250–252 (e.g., walls) therebetween which define a turning space 253. The internal forming device 223 may be the same as the internal forming device 123, having an upper leg portion 256, a lower leg portion 257 and a bight portion 258 joined together in a pinched U-shape that generally corresponds in appearance to a bobby pin.

The internal forming device 224 comprises a pair of interacting portions 264, a pair of supporting portions 265, a pair of connecting portions 266, a brace portion 267 and a bridge portion 268. The portions 265–268 coordinate to correctly position the interacting portions 264 relative to the external forming device 222. Specifically, the interacting portions 264 are positioned downstream of the chute's outlet 249, are symmetrically situated relative to the lateral center of the turning space 253, and are longitudinally aligned with the chute's inlet 248 and outlet 249.

The supporting portions 265, the connecting portions 266, the brace portion 267 and the bridge portion 268 are essentially the same as the portions 165–168 of the internal forming device 124. Accordingly, the supporting portions 265 are coupled to the machine's housing 204 upstream of the chute's inlet 248 and extend through the turning space 253 defined by the external forming device 222. Also, the supporting portions 265 (and thus the interacting portions 264) are longitudinally and/or laterally adjustable relative to the chute's outlet 249 (and thus the turning space 253). As was explained above in connection with the internal forming device 124, longitudinal adjustment may be accomplished by mounting the connecting portions 266 to the machine's housing 204 in such a manner that selective longitudinal movement is possible. In the internal forming device 224, this longitudinal adjustment may be additionally or alternatively accomplished by selectively sliding the interacting portions 264 along the connecting portions 266.

The interacting portions 264 comprise mandrel portions attached to the downstream ends of the supporting potions 265. The mandrel portions have a greater cross-sectional area than the supporting portions 265. Specifically, each of the mandrel portions 264 comprises an upstream cone-shaped section 281, a cylindrical-shaped section 282 and downstream cone-shaped section 283. In the illustrated embodiment, the mandrel portions 264 and the supporting portions 265 are separate members and the mandrel sections 281–283 have a concentric core 284 through which the downstream ends of the supporting portions 265 extends. However, mandrel portions formed in one piece with supporting portions are possible with, and contemplated by, the present invention.

The upstream cone-shaped section 281 is the longest mandrel section and has a circular cross-sectional area which increases in the downstream direction. The cylindrical-shaped section 282 is the shortest mandrel section and has the same cross-sectional area as the downstream end of the cone-shaped section 281. The downstream cone-shaped section 283 is longitudinally sized to simply provide a transition curve for the stock material from the mandrel portion 264.

As the stock material travels through the turning space 253 of the external forming device 222, its surfaces 250–252 radially restrict the stock material to cause inward turning of the lateral regions of the stock material. (FIG. 20A.) In the preferred and illustrated cushioning conversion machine 200, the internal forming device 223 coacts with the chute 222 to cause this inward turning. In any event, the strip of stock material emerges from the chute's outlet 249 having a certain cross-sectional geometry. (FIG. 20B.) Downstream of the chute's outlet 249, the interacting mandrel portions 264 of the internal forming device 224 re-shape the cross-sectional geometry of the strip of stock material. (FIG. 20C.) During the re-shaping of the strip of stock material S, the upstream mandrel sections 281 play the dominate reshaping role and the interacting portions 264 of the internal forming device 224 are shaped to increase the lateral dimension and the non-lateral transverse dimension of the cross-sectional geometry of the strip.

Cushioning Conversion Machine 300

Referring now to FIGS. 21–23, the cushioning conversion machine 300 is schematically shown in FIGS. 21 and 22, and the formation of the stock material as it passes through the cushioning conversion machine 300 is schematically shown in FIGS. 23A–23C.

The machine 300 comprises a conversion assembly 301 (including a forming assembly 320 and a feeding assembly 321) which converts the stock material into a three-dimensional strip of cushioning. Except for its forming assembly 320, the machine 300 may be of the same construction as the cushioning conversion machine 100. Additionally, the machine 300 may incorporate the previously described extruding device 190 and/or the extruding device 194.

The forming assembly 320 comprises an external forming device 322, an internal forming device 323 and another internal forming device 324 which are preferably positioned within a common envelope defined by the machine housing 304. The external forming device 322 may be the same as the external forming device 122 (e.g., a converging chute) having an inlet 348, an outlet 349, and surfaces 350–352 (e.g., walls) therebetween which define a turning space 353. The internal forming device 323 may be the same as the internal forming device 123, having an upper leg portion 356, a lower leg portion 357 and a bight portion 358 joined together in a pinched U-shape that generally corresponds in appearance to a bobby pin. (FIGS. 21 and 22.)

The internal forming device 324 comprises a pair of interacting portions 364 and a supporting portion 365. The supporting portion 365 is a laterally extending rod-like member and the interacting portions 364 are mounted on opposite ends thereof. Preferably, the supporting portion 365 may be selectively extended (such as by a telescoping arrangement) so that lateral adjustment of the interacting portions 364 relative to the turning space 353 is possible.

The supporting portion 365 is mounted to the machine housing 304 via a suspension strap 370. The supporting portion 365 and the suspension strap 370 coordinate to correctly position the interacting portions 364 relative to the external forming device 322. Specifically, the interacting portions 364 are positioned downstream of the chute's outlet 349, are symmetrically situated relative to the lateral center of the turning space 353, and are longitudinally aligned with the chute's inlet 348 and outlet 349. (FIGS. 21 and 22.)

As is best shown in FIG. 23B, the suspension strap 370 comprises sections 371–373 which are sized and arranged to allow the strip of cushioning to travel therearound. Particularly, the short first section 371 extends upwardly from the supporting portion 365, the longer second section 372 extends almost horizontally (but with a slight upward slant) inward from the upper end of the first section 371, and the third vertical section 373 extends upwardly from the other end of the second section 372.

The suspension strap 370, and more particularly the upper end of the section 373, is attached to a longitudinally extending mounting bracket 374. (FIGS. 21 and 22.) The mounting bracket 374 is supported in a cantilever fashion from an upstream portion of the machine housing 304, such as the downstream end wall 307. Thus, the supporting portion 365 is mounted to the machine housing 304 downstream of the chute's outlet 349. The mounting bracket 374 includes a longitudinal slot 375 and the upper end of the suspension strap 370 (e.g., the top end of its vertical section 373) is threaded. (FIG. 21.) To mount the supporting portion 365 on the machine housing 304, the threaded upper end of the suspension strap 370 is inserted through the slot 375, moved to the appropriate longitudinal position, and then locked in place by locking members 376 (e.g., threaded bolts). (FIG. 22.) In this manner, the supporting portion 365, and thus the interacting portions 364, are longitudinally adjustable relative to the outlet 349 and/or the turning space 535 of the external forming device 322.

The interacting portions 364 preferably comprise mandrel portions having a greater cross-sectional area than the supporting portions 365. Specifically, each of the mandrel portions 364 comprises an upstream cone-shaped section 381, a cylindrical-shaped section 382 and downstream hemispherical-shaped section 383. The upstream cone-shaped section 381 is the longest mandrel section and has a circular cross-sectional area which increases in the downstream direction. When compared to the section 281 of the mandrel portion 264 (FIG. 18), the section 381 has a much more pointed upstream end. The cylindrical-shaped section 382 is the shortest mandrel section and has the same cross-sectional area as the downstream end of the cone-shaped section 381. The downstream hemispherical-shaped section 383 is sized to simply provide a transition curve for the stock material from the mandrel member 364.

As the stock material travels through the turning space 353 of the external forming device 322, the surfaces 350–352 radially restrict the stock material to cause inward turning of its lateral regions. (FIG. 23A.) In the preferred and illustrated cushioning conversion machine 300, the internal forming device 323 coacts with the chute 322 to cause this inward turning. In any event, the strip of stock material emerges from the chute's outlet 349 having a certain cross-sectional geometry. (FIG. 23B.) Downstream of the chute's outlet 349, the interacting mandrel portions 364 of the internal forming device 324 internally re-shape the cross-sectional geometry of the strip of stock material. (FIG. 23C.) During this re-shaping, the upstream mandrel sections 381 play the dominate reshaping role and the interacting portions 364 of the internal forming device 324 are shaped to increase the lateral dimension and the non-lateral transverse dimension of the cross-sectional geometry of the strip of stock material.

Cushioning Conversion Machine 400

Referring now to FIGS. 24–26, the cushioning conversion machine 400 is schematically shown in FIGS. 24 and 26, and the conversion of the stock material as it passes through the machine is shown in FIGS. 26A and 26B.

The machine 400 comprises a conversion assembly 401 (including a forming assembly 420 and a feeding assembly 421) which converts the stock material into a three-dimensional strip of cushioning. Except for its forming assembly 420, the machine 400 may be the same as the cushioning conversion machine 100. Additionally, the machine 400 may incorporate an extruding device, such as the extruding device 590 introduced below in connection with the cushioning conversion machine 500.

The forming assembly 420 comprises an external forming device 422, an internal forming device 423 and another internal forming device 424 which are preferably positioned within a common envelope defined by the machine housing 404. The devices 422–424 are positioned so that the stock material travels through the external forming device 422 and around the internal forming devices 423 and 424. The external forming device 422 may be the same as the external forming device 122 (e.g., a converging chute) having an inlet 448, an outlet 449, and surfaces 450–452 (i.e., walls) therebetween which define a turning space 453. The internal forming device 423 may be the same as the internal forming device 123, having an upper leg portion 456, a lower leg portion 457 and a bight portion 458 joined together in a pinched U-shape that generally corresponds in appearance to a bobby pin.

The internal forming device 424 comprises a pair of mandrel portions 464, a pair of supporting portions 465, a pair of connecting portions 466, a brace portion 467, and a bridge portion 468. The portions 465–468 may be the same construction as the corresponding portions 165–168 in the internal forming device 124. Also, the bridge portion 468 is preferably attached to the supporting portions 465 with adjustable couplings 469 and mounted to the machine's housing 404 via a suspension strap 470. In this manner, the supporting portions 465 are mounted to the machine housing 404 upstream of the chute's inlet 448 and extend longitudinally through the turning space 453. Further, the mandrel portions 464 are laterally adjustable relative to each other and are longitudinally adjustable relative to the chute's outlet 449.

The mandrel portions 464 are similar to the mandrel portions 264 of the internal forming device 224. Specifically, the mandrel portions 464 are attached to the downstream ends of the supporting portions 465 and have a greater cross-sectional area than the supporting portions 465. Also, each of the mandrel portions 464 comprises an upstream cone-shaped section 481, a cylindrical-shaped section 482 and downstream cone-shaped section 483, similar to the mandrel sections 281–283, and a concentric core 484 through which the downstream ends of the supporting portions 465 extend. Again, mandrel portions formed in one piece with the supporting portions are possible with, and contemplated by, the present invention. However, if the illustrated construction is used, the mandrel portions 464 may be selectively shifted on the supporting portions 466 to longitudinally adjust their position in the same manner as the mandrel portions 264 of the internal forming device 124.

As in the internal forming device 224, the supporting portions 465 correctly position the mandrel portions 464 relative to the external forming device 422. Specifically, the interacting portions 464 are symmetrically situated relative to the lateral center of the turning space 453, and are longitudinally aligned with the chute's inlet 448 and outlet 449. However, in contrast to the internal forming device 224, the mandrel portions 464 are not positioned downstream of the chute's outlet 449. Instead, the mandrel potions 464 are positioned within the turning space 453, preferably adjacent to the outlet 449 of the external forming device 422.

As the stock material travels through the turning space 453 of the external forming device 422, the surfaces 450–452 radially restrict the stock material and the portions 464–466 of the internal forming device 424 define a turning perimeter around which the lateral regions of the stock material are inwardly turned. (FIGS. 26A and 26B.) Particularly, the supporting portions 465 are co-planar portions sloped slightly in the downstream direction. (FIG. 25.) The mandrel portions 464 project beyond the coplanar portion in both the lateral and non-lateral transverse directions. (FIGS. 24 and 25.) In this manner, the mandrel portions 464 internally shape the strip of stock material prior to it emerging from the chute's outlet 449. (FIGS. 26A and 26B.) During this pre-outlet shaping, the upstream mandrel sections 481 play the dominate and the mandrel portions 464 of the internal forming device 424 are shaped to increase the lateral dimension and the non-lateral transverse dimension of the cross-sectional geometry of the strip of stock material.

Cushioning Conversion Machine 500

Referring now to FIGS. 27–29, the cushioning conversion machine 500 is schematically shown in FIGS. 27 and 28, and the conversion of the stock material as it passes through the machine 500 is shown schematically in FIGS. 29A–29C.

The machine 500 comprises a conversion assembly 501 (including a forming assembly 520 and a feeding assembly 521) which converts the stock material into a three-dimensional strip of cushioning. Except for its forming assembly 520, the machine 500 may be of the same construction as the cushioning conversion machine 100.

The forming assembly 520 comprises an external forming device 522, an internal forming device 523 and another internal forming device 524 which are preferably positioned within a common envelope defined by the machine housing 504. The devices 522–524 are positioned so that the stock material travels through the external forming device 522 and around the internal forming devices 523 and 524 as it travels through the forming assembly 520. The external forming device 522 may be the same as the external forming device 122 (e.g., a converging chute) having an inlet 548, an outlet 549, and surfaces 550–552 (i.e., walls) therebetween which define a turning space 553. The internal forming device 523 may be the same as the internal forming device 123, having an upper leg portion 556, a lower leg portion 557 and a bight portion 558 joined together in a pinched U-shape that generally corresponds in appearance to a bobby pin.

The internal forming device 524 comprises a pair of mandrel portions 564, a pair of supporting portions 565, a pair of connecting portions 566, and a bridge portion 567.

The supporting portions 565 are generally straight rod-like members which extend through the turning space 553 of the chute 522 longitudinally at an angle approximately equal to the converging angle of the chute's side walls 552 (FIG. 27) and transversely at an angle equal to the sloped angle of the chute's bottom wall 551 (FIG. 28). The connecting portions 566 are also rod-like members which extend inwardly and upwardly from the downstream ends of the supporting portions 565. (FIGS. 27 and 28.) The bridge portion 567 is attached to an upstream portion of the machine's housing 504 and the upstream ends of the connecting portions 566 are attached thereto. (FIG. 28.) Thus, the supporting portions 565 extend from a position upstream of the chute's inlet 548 and longitudinally through the turning space 553.

In contrast to the generally cone-shaped geometry of the mandrel portions 464 of the internal forming device 424, the mandrel portions 564 are cylindrical in shape. The preferred mandrel portions 564 each include a single cylindrical section 581 having chaffered edges giving it a barrel-like shape. Each mandrel portion 564 has a central core 584 through which the supporting portions 565 extend. However, cylindrical or otherwise shaped mandrel portions formed in one piece with supporting portions are possible with, and contemplated by, the present invention. That being said, the illustrated construction allows the mandrel portions 564 to be selectively slid along the supporting portions 565 thereby providing longitudinal adjustment of the mandrel portions 564 relative to the turning space 553.

As in the internal forming device 424, the supporting portions 565 correctly position the mandrel portions 564 relative to the external forming device 522. Specifically, the interacting portions 564 are symmetrically situated relative to the lateral center of the turning space 553, and are longitudinally aligned with the chute's inlet 548 and outlet 549. The mandrel portions 564, like the mandrel portions 464, are positioned within the turning space 453. However, instead of being adjacent to the chute's outlet 549, the mandrel portions 564 are positioned approximately intermediate between the chute's inlet 548 and its outlet 549.

Also in contrast to the internal forming device 424, the supporting portions 465 extend beyond the outlet 549 of the external forming device 522. In the illustrated; machine 500, the downstream ends of the supporting portions 465 are not intended to interact with the strip of stock material. However, with appropriate positioning, the downstream ends of the supporting portions 465 could be used as post-outlet interacting portions, in the same manner as the downstream ends of the supporting portions 165 in the cushioning conversion machine 100.

The cushioning conversion machine 500 may also incorporate an extruding device 590. The extruding device 590 comprises a pair of extruding members 591 and support structure 592 for supporting the extruding members 591. The extruding members 591 are positioned downstream of the chute's outlet 549 and are positioned to contact lateral sides of the strip of stock material. In the illustrated embodiment, the extruding members 591 are guide cylinders and the support structure 592 comprises a pair of vertical shafts inserted through an axially extending core of the guide members. The cores are eccentrically (i.e., non centrally located) on each of the guide members 591 to allow selective adjustment of the spacing or distance between the guide members 591. An exemplary form of this and other types of extruding devices (called "pad adjustment devices") are disclosed in detail in International Application No. PCT US98/04655. (This application is assigned to the assignee of the present application and its entire disclosure has already been incorporated by reference.)

As the stock material travels through the turning space 553 of the external forming device 522, its surfaces 550–553 radially restrict the stock material to cause inward turning of its lateral regions. During this inward turning, the bottom surface of the lower leg portion 557 of the internal forming device 523 forms a holding surface which holds the central region of the stock material. Also, the portions 564–565 of the internal forming device 524 define a turning perimeter around which the lateral regions of the stock material are inwardly turned. (FIGS. 29A–29C.) Particularly, the supporting portions 565 are co-planar portions sloped slightly in the downstream direction. (FIG. 28.) The mandrel portions 564 project beyond the coplanar portions 565 in both the lateral and non-lateral transverse directions. (FIGS. 27 and 28.) In this manner, the mandrel portions 564 internally shape the strip of stock material prior to it emerging from the chute's outlet 549. (FIGS. 29B and 29C.) During this pre-outlet shaping, the mandrel portions 564 of the internal forming device 524 are shaped to increase the lateral dimension and the non-lateral transverse dimension of the cross-sectional geometry of the strip of stock material. After the strip of stock material emerges from the chute's outlet 549, the extruding device 590 externally reshapes its cross-sectional geometry. (FIG. 29C.)

Cushioning Conversion Machine 600

Referring now to FIGS. 30–32, the cushioning conversion machine 600 is schematically shown in FIGS. 30 and 31, and the conversion of the stock material as it passes through the cushioning conversion machine 600 is shown in FIG. 32.

The machine 600 comprises a conversion assembly 601 (including a forming assembly 620 and a feeding assembly 621) which converts the stock material into a three-dimensional strip of cushioning. Except for its forming assembly 620, the machine 600 may be the same as the cushioning conversion machine 100.

The forming assembly 620 comprises an external forming device 622 and an internal forming device 624 which are preferably positioned within a common envelope defined by the machine housing 604. These devices are positioned so that the stock material passes through the external forming device 622 and around the internal forming device 624 as its passes through the forming assembly 620. The external forming device 622 may be the same as the external forming device 122 (e.g., a converging chute) having an inlet 648, an outlet 649, and surfaces 650–652 (i.e., walls) therebetween which define a turning space 653.

The illustrated internal forming device 624 was constructed by retrofitting (or more accurately adding onto) the internal forming device 123 of the cushioning conversion machine 100. The internal forming device 624 has an upper leg portion 656, a lower leg portion 657 and a bight portion 658 joined together in a pinched U or bobby pin shape. The internal forming device 624 may include an adjustment member for varying the relative inclination and/or spacing between the lower leg portion 657 and the chute's bottom wall 651. Additionally or alternatively, the internal forming device 624 may be mounted to the machine housing 604 in much the same manner as the internal forming device 123, specifically with a suspension strap and a mounting bracket. (The suspension strap, the mounting bracket, and the adjustment member are not shown in the drawings, however, they may be the same as the analogous components 159–161 in the internal forming device 123.)

The internal forming device 624 additionally comprises an interacting portion 664 attached to the downstream end of the lower leg portion 657. The portions 656–658 of the forming device 624 may be viewed as supporting portions which correctly position the interacting portion 664 relative to the external forming device 622. Specifically, the interacting portion 664 is positioned so that at least its downstream regions are positioned downstream of the chute's outlet 649, are symmetrically situated relative to the lateral center of the turning space 653, and are longitudinally aligned with the chute's inlet 648 and outlet 649. As is explained in more detail below, the interacting portion 664 function to re-shape the cross-sectional geometry of the strip after it emerges from the outlet 649 of the external forming device 622.

The interacting portion 664 is preferably a mandrel portion including a section 685 positioned substantially in the lateral plane. The mandrel section 685 has a generally trapezoidal shape increasing in width in the downstream direction and projects laterally outward from the downstream end of the lower leg portion 657. In this manner, the interacting portion 664 is positioned to internally interact with lateral portions of the strip of stock material and is shaped to increase the lateral dimension of the cross-sectional geometry of the strip.

The mandrel portion 664 preferably also includes wing sections 686 which are symmetrically positioned relative to the turning space 653. (FIG. 30.) The wing sections 686 perpendicularly project from the planar section 685 and each has a generally triangular-shaped geometry sloping away from section 685 in the downstream direction. (FIG. 31.) The wing sections 686 may project above and/or below the planar section 685. In the illustrated embodiment, the wing sections 686 project above and below the planar section 685 whereby the lower wing regions project beyond a plane extending from the downstream edge of the holding surface to the upstream end of the holding surface.

Alternatively, the wing sections 686 could be of the same shape as the wing sections 786 of the cushioning conversion machine 700, as described below. In either case, the wing sections 686 result in the interacting or mandrel portion 664 also being shaped to increase the non-lateral transverse dimension of the cross-sectional geometry of the strip of stock material.

The mandrel section 685 preferably includes longitudinal slots 687 for its attachment to the downstream end of the lower leg portion 657 via attachment members 688. Particularly, the attachment members 688 (i.e., threaded nut and bolts) are inserted through the openings and the slots 687 and then locked in place. By longitudinally shifting the attachment members 688 along the slots 687, the longitudinal positioning of the mandrel portion 664 relative the lower leg portion 657 may be adjusted. In other words, the interacting or mandrel portion 664 is longitudinally adjustable relative to the chute's outlet 649.

As the stock material travels through the turning space 653 of the external forming device 622, the surfaces 650–652 radially restrict the stock material to cause inward turning of its lateral regions. (FIG. 32A.) In the cushioning conversion machine 600, at least some of the portions 656–658 of the internal forming device 624 coact with the chute 622 to cause this inward turning. In any event, the strip of stock material emerges from the chute's outlet 649 having a certain cross-sectional geometry. (FIG. 32B.) Downstream of the chute's outlet 649, the interacting or mandrel portion 664 of the internal forming device 624 internally re-shape the cross-sectional geometry of the strip of stock material. (FIG. 32C.) During this re-shaping, the mandrel section 685 increases the lateral dimension and the wing sections 686 increase the non-lateral transverse dimension of the cross-sectional geometry of the strip. Thus, the mandrel section 685 and the wing sections 686 are accordingly shaped to effect this increase and positioned to interact with the lateral portions of the strip.

Cushioning Conversion Machine 700

Referring now to FIGS. 33–35, the cushioning conversion machine 700 is schematically shown in FIGS. 33 and 34, and the conversion of the stock material as it passes through the cushioning conversion machine 700 is shown in FIGS. 35A–35C. The machine 700 comprises a conversion assembly 701 (including a forming assembly 720 and a feeding assembly 721) which converts the stock material into a three-dimensional strip of cushioning. Except for its forming assembly 720, the machine 700 may be the same as the cushioning conversion machine 100.

The forming assembly 720 comprises an external forming device 722 and an internal forming device 724 which are preferably positioned within a common envelope defined by the machine housing 704. These devices are positioned so that the stock material passes through the external forming device 722 and around the internal forming device 724 as its passes through the forming assembly 720. The external forming device 722 may the same as the external forming device 122 (e.g., a converging chute) having an inlet 748, an outlet 749, and surfaces 750–752 (i.e., walls) therebetween which define a turning space 753.

The illustrated internal forming device 724 was constructed in the same manner as the internal forming device 624 discussed above. Specifically, the device 724 was constructed by retrofitting (or more accurately adding onto) the internal forming device 123 of the cushioning conversion machine 100. The internal forming device 724 has an upper leg portion 756, a lower leg portion 757 and a bight portion 758 joined together in a pinched U or bobby pin shape. The internal forming device 724 may include an adjustment member 759 for varying the relative inclination and/or spacing between the lower leg portion 757 and the chute's bottom wall 751. Additionally or alternatively, the internal forming device 724 may be mounted to the machine housing 704 in much the same manner as the internal forming device 123, specifically with a suspension strap and a mounting bracket. (Again, the adjustment member, the suspension strap, and the bracket are not shown in the drawings but may be the same as the analogous components 159–161 in the internal forming device 123.)

Like the internal forming device 624, the internal forming device 724 additionally comprises a mandrel portion 764 attached to the downstream end of the lower leg portion 757. Also like the internal forming device 624, the portions 756–758 of the forming device 724 may be viewed as supporting portions which correctly position the mandrel portion 764 relative to the external forming device 722. Specifically, the interacting portion 764 is situated relative to the lateral center of the turning space 753, and is longitudinally aligned with the chute's inlet 748 and outlet 749. However, in contrast to the internal forming device 624, in the internal forming device 724, the mandrel or interacting portion 764 is positioned at least partially upstream of the chute's outlet 749. As is explained in more detail below, the mandrel portion 764 internally shapes the cross-sectional geometry of the strip just before it emerges from the outlet 749 of the external forming device 722.

The interacting portion 764 is preferably a mandrel portion including a section 785 positioned substantially in the lateral plane. The mandrel section 785 has a generally trapezoidal shape increasing in width in the downstream direction and projects laterally outward from the downstream end of the lower leg portion 757. The lower surface of the mandrel section 785 forms a co-planar extension of the holding surface which holds the central region of the stock material as it travels through the turning space 653.

The mandrel portion 764 preferably also includes wing sections 786 which project from the planar section 785 and are symmetrically positioned relative to the longitudinal center line of the turning space 753. (FIG. 33.) In the illustrated embodiment, the wing sections 786 are formed from lateral side edges of the planar section 785 being curved upwardly (and then inwardly) in a cupping fashion. Alternatively, the wing sections 786 could be of the same shape as the wing sections 686 of the cushioning conversion machine 600, described above.

The mandrel section 785 preferably includes longitudinal slots 787 for its attachment to the downstream end of the lower leg portion 757 via attachment members 788. As with the internal forming device 624, the slots 787 allow the mandrel portion 764 to be longitudinally adjustable relative to the chute's outlet 749.

As the stock material travels through the turning space 753 of the external forming device 722, the surfaces 750–752 radially restrict the stock material to cause inward turning of its lateral regions. (FIG. 35A.) During this inward turning, the coplanar bottom surfaces of the lower leg portion 757 and the mandrel portion 764 hold central regions of the stock material. The trapezoidal section 785 projects laterally outward from the downstream end of the leg portion 757 and the wing sections 786 project beyond the plane of the holding surface. (FIGS. 35B and 35C.) In this manner, the mandrel portion 764 internally shapes the strip of stock material prior to it emerging from the chute's outlet 749.

Cushioning Conversion Machine 800

Referring now to FIGS. 36–41, the cushioning conversion machine 800 is schematically shown in FIGS. 36 and 37 and the conversion of the stock material as it passes through the machine 800 is shown in FIGS. 38A–38C.

The machine 800 comprises a conversion assembly 801 (including a forming assembly 820 and a feeding assembly 821) which converts the stock material into a three-dimensional strip of cushioning. Instead of the separating device 134 and the constant-entry roller 135, the machine 800 preferably includes the "bull's eye" arrangement of separator members and the constant-entry device disclosed in U.S. Provisional Patent Application No. 60/085,721, filed on May 15, 1998. Otherwise, except for the forming assembly 820, the machine 800 may be of the same construction as the cushioning conversion machine 100.

The forming assembly 820 comprises an external forming device 822 and an internal forming device 824 which are preferably positioned within a common envelope defined by the machine housing 804. These devices are positioned so that the stock material passes through the external forming device 822 and around the internal forming device 824 as its passes through the forming assembly 820. The external forming device 822 may be the same as the external forming device 122 (e.g., a converging chute) having an inlet 848, an outlet 849, and surfaces 850–852 (i.e., walls) therebetween which define a turning space 853.

The internal forming device 824 is shown in FIGS. 39, 40 and 41. In the illustrated embodiment, the internal forming device 824 is made by retrofitting the internal forming device (called "a three-dimensional forming frame") shown in U.S. Pat. No. 4,750,896. The internal forming device 824 has a body 856 and ribs 857, 858 and 859 which are made of a bar-like material, such as metal rod. The body 856 is V-shaped when viewed from the top and is positioned in a common plane which is tilted in the downstream direction. (FIGS. 37 and 40.) The ribs 857–859 extend substantially perpendicularly down from the body 856 and are generally U-shaped when viewed from the downstream end. (FIGS. 40 and 41.) The internal forming device 824 may further comprise mounting rods 860 for mounting the device to the machine housing 804. (FIG. 41.)

The internal forming device 824 further comprises mandrel portions 864 which are attached to the body 856. (FIGS. 40 and 41.) More specifically, the body 856 comprises a pair of converging leg portions 865 joined together at their downstream ends by a nose portion 866 and the mandrel portions 864 are attached to a top region of the leg portions 865. (FIGS. 39 and 40.) The leg portions 865 are of approximately the same construction and length as the corresponding leg portions of the pre-retrofitted device.

The nose portion 866 is approximately two inches wider than the corresponding nose portion in the pre-retrofitted device. In the illustrated retrofitted embodiment, the increase in width of the nose portion 866 is accomplished by a two inch extension piece centrally inserted therein. (FIG. 39.) For example, the nose portion of the pre-retrofitted device could be centrally cut and then the extension piece sandwiched between the cuts and secured in place by welding. However, if the internal forming device 824 is not being made as a retrofit, this increase in width could be accomplished during the initial manufacturing process. In any event, the nose portion 866 has a more flattened U-shape as opposed to the rounded corner shape of the pre-retrofitted nose portion and thus the nose portion 866 includes a lateral transverse component.

Whatever the shape of the nose portion 866, the body's leg portions 865 are mandrel-supporting portions which extend through the turning space 853 and position the mandrel portions 864 symmetrically relative to the turning space 853. (FIGS. 36 and 37.) The leg portions 865 are positioned within a common plane and the mandrel portions 864 project beyond these co-planar portions in the upward (non-lateral transverse) direction. (FIGS. 37, 40 and 41.)

The mandrel portions 864 are preferably made of the same bar-like material as the rest of the internal forming device 824. Each mandrel portion 864 is generally L-shaped having a long section 881 and a shorter section 882 extending from one end thereof. (FIGS. 40 and 41.) The comer between the sections 881 and 882 preferably forms a slightly less than perpendicular (i.e., 75° to 80°) angle. (FIG. 40.) Preferably, the distal end of the long section 881 has a contoured edge to lay substantially flush against the top surface of the leg portion 865. (FIG. 39.) The distal end of the shorter section 882 is attached to the leg portion 865 just upstream of the nose portion 866. (FIG. 40.) In this manner, the mandrel portions 864 are positioned just adjacent the outlet 849 of the external forming device 822. (FIGS. 36, 37.)

The upstream rib 857 comprises a pair of side leg portions 885 connected together by a bottom leg portion 886. (FIG. 41.) The upper ends of each of the side leg portions 885 are connected, via a rounded corner, to the upstream end of the respective leg portions 865 of the V-shaped body 856. (FIGS. 39 and 40.) The downstream rib 858 likewise comprises a pair of side leg portions 887 connected together by a bottom leg portion 888. (FIG. 41.) The upper ends of each of the side leg portions 887 are connected to aligned sections of the leg portions 865 of the V-shaped body 856, these sections being located between its upstream and downstream ends. (FIGS. 39 and 41.)

The side leg portions 885 and 887 are of approximately the same height as the corresponding side leg portions of the pre-retrofitted device. The bottom leg portions 886 and 888 are approximately two inches wider than the corresponding leg portions in the pre-retrofitted device. As with the nose portion 866, the increase in width of the ribs' bottom leg portions 886 and 888 is accomplished by a two inch extension piece centrally inserted therein. However, if the internal forming device 824 was not being made as a retrofit, the width of the leg portions 886 and 888 could be adjusted during the initial manufacturing process. Specifically, the body 856 and the upstream rib 857 could be formed from a continuous piece of rod-like material while the downstream rib 858 could be formed from a separate piece and welded to the body 856.

The rib 859 comprises a pair of side leg portions 889 connected together by a bottom leg portion 890. (FIGS. 40 and 41.) The upper ends of each of the side leg portions 889 are connected to aligned sections of the leg portions 865 of the V-shaped body 856, at the same point as the side leg portions 887 of the rib 858. (FIGS. 39 and 40.) It may be noted that while the side leg portions 887 of the rib 858 slant inwardly to meet the bottom leg portion 888, the side leg portions 889 of the rib 859 extend generally perpendicularly from the plane of the body 856. (FIG. 41.) Thus, the rib 859 extends transversely beyond the rib 858 in both the lateral and non-lateral direction and the rib 859 "overshadows" or "supercedes" the rib 858. As such, the rib 858 does not contact the stock material during the forming process whereby, if the internal forming device 824 was not being made as a retrofit, the rib 858 could be eliminated.

In the internal forming device 824, the bottom leg portion 886 of the upstream rib 857, the bottom leg portion 888 of the downstream rib 858, and nose portion 866 of the body are situated in the same plane in a triangular configuration. (FIG. 40.) Particularly, when a line is drawn, one of the ends of the bottom leg portion 886 of the upstream rib 857 to the vertex of the nose portion 866, it passes through the corresponding end of the bottom leg portion 888 of the downstream rib 858. When a line is drawn from the other end of the bottom leg portion 886 of the upstream rib 857 to the vertex of the nose portion 866, it passes through the other end of the bottom leg portion 888 of the downstream rib 858. Likewise, when a line is drawn from a central point of the bottom leg portion 886 to the vertex of the nose portion 866, it passes through a central point of the bottom leg portion 888 of the downstream rib 858. However, the bottom leg portion 890 of the rib 859 extends below this line whereby this portion 890 forms a projection which projects beyond a plane extending from the upstream edge of the surface (the bottom leg portion 886) to the downstream edge of the surface (the nose portion 866).

As the stock material travels through the turning space 853 of the external forming device 822, the surfaces 850–852 radially restrict the stock material to cause inward turning of its lateral regions. (FIG. 38A.) During this inward turning, the side leg portions 865 and the mandrel portions 864 define a turning perimeter around which the lateral regions of the stock material are inwardly turned. Also, the bottom leg portion 886 of the rib 857, the bottom leg portion 890 of the superceding rib 859 and the nose portion 866 of the body 856 form a "holding surface" which holds the central regions of the stock material as its lateral regions are inwardly turned. (FIG. 37.) The increased travel path of the central regions of the stock material around the superceding rib 859 results in less stock material being inwardly turned to form the central region of portion of the strip. (FIG. 38B.) The mandrel portions 864 project beyond the coplanar portions 866 of the turning perimeter to internally shape the strip of stock material prior to it emerging from the chute's outlet 849. (FIG. 38C.) During this pre-outlet shaping, the mandrel portions 864 of the internal forming device 824 are shaped to increase the non-lateral transverse dimension (i.e., loft) of the cross-sectional geometry of the strip of stock material.

Cushioning Conversion Machine 900

Referring now to FIGS. 42–44, a cushioning conversion machine 900 is shown schematically in FIGS. 42 and 43 and the conversion of the stock material is shown schematically in FIGS. 44A–44C.

The machine 900 comprises a conversion assembly 901 (including a forming assembly 920 and a feeding assembly 921) which converts the stock material into a three-dimensional strip of cushioning. The rotating members 926 and 927 of the feeding assembly 921 are preferably of the type disclosed in PCT International Publication No. WO 96/40493 and have meshing projections which cooperate to form a row of tabs for interlocking the overlapped portions of the stock material. (The invention disclosed in this PCT publication is assigned to the assignee of the present application and the entire disclosure of this publication has already been incorporated by reference.) However, while the rotating members disclosed in this PCT publication have eleven projections, the rotating members 926 and 927 of the feeding assembly 921 have a lesser number of projections, such as nine or ten projections. Otherwise, except for forming assembly 920, the machine 900 may be of the same construction as the cushioning conversion machine 100.

The forming assembly 920 comprises an external forming device 922 and an internal forming device 924 which are preferably positioned within a common envelope defined by the machine housing 904. These devices are positioned so that the stock material passes through the external forming device 922 and around the internal forming device 924 as its passes through the forming assembly 920. The external forming device 922 may be the same as the external forming device 422 (e.g., a converging chute) having an inlet 948, an outlet 949, and surfaces 950–952 (i.e., walls) therebetween which define a turning space 953. (FIGS. 42 and 43.)

The internal forming device 924 is made by retrofitting the internal forming device (called "a three-dimensional forming frame") shown in U.S. Pat. No. 4,750,896. (This patent is assigned to the assignee of the present invention and has already been incorporated by reference.) The internal forming device 924 has a body 956 and ribs 957, 958 and 959 which are made of a bar-like material, such as metal rod. The ribs 957–959 extend substantially perpendicularly down from the body 956 and are generally U-shaped when from viewed from the downstream end. The internal forming device 924 may further comprise mounting rods 960 for mounting the device to the machine housing 904 and more particularly to a suspension strap 961 cantilevered from an upstream section of the machine's housing 904. (FIGS. 45–47.)

The "pre-retrofitted" internal forming device (i.e., the forming frame disclosed in U.S. Pat. No. 4,750,896)

includes the upstream rib 957 and the intermediate rib 958, but does not include the downstream rib 959. Instead, the downstream rib 959 replaces a "nose portion" of the body 956 that was co-planar with the other portions of the body 956, namely converging leg portions 965 introduced below. (FIG. 42.) As such, the body 956 is generally V-shaped when from viewed from the top, or more particularly shaped like a V with a cut-off vertex in view of the downstream rib 959. 8.) The body 956 is positioned in a common plane which is tilted in the downstream direction relative to the chute 922. (FIG. 43.)

The internal forming device 924 further comprises mandrel portions 964 which are attached to the body 956. More specifically, the body 956 comprises a pair of converging leg portions 965 to which the mandrel portions 964 are attached. The upstream ends of the leg portions 965 are attached to the upstream rib 957 and the downstream ends of the leg portions are attached to the downstream rib 959. The leg portions 965 may be of approximately the same construction as the corresponding leg portions of the pre-retrofitted device.

In any event, the converging leg portions 965 are mandrel-supporting portions which extend through the turning space 953. The mandrel portions 964 are attached to the downstream ends of the supporting portions 965 and have a greater cross-sectional area than the supporting portions 965. The supporting portions 965 correctly position the mandrel portions 964 relative to the external forming device 922. Specifically, the mandrel portions 964 are symmetrically situated relative to the lateral center of the turning space 953, and are longitudinally aligned with the chute's inlet 948 and outlet 949. Additionally, the mandrel portions 964 are preferably positioned within the turning space 953, preferably adjacent to the outlet 949 of the external forming device 922. To this end, the mandrel portions 964 are positioned near the downstream ends of the leg portions 965, just upstream of the rib 959.

The mandrel portions 964 are preferably the same as the mandrel portions 464 of the cushioning conversion machine 400. Thus, the each of the mandrel portions 964 comprises an upstream cone-shaped section 981, a cylindrical-shaped section 982 and downstream cone-shaped section 983. In the illustrated embodiment, the mandrel portions 964 and the supporting portions 965 are separate members and the mandrel sections 981–983 have a concentric core through which the downstream ends of the supporting portions 965 extends. This construction allows the mandrel portions 964 to be selectively slid along the supporting portions 965 thereby providing longitudinal adjustment of the mandrel portions 964 relative to the turning space 953. However, mandrel portions formed in one piece with supporting portions are possible with, and contemplated by, the present invention.

The upstream rib 957 comprises a pair of side leg portions 985 connected together by a bottom leg portion 986. The upper ends of each of the side leg portions 985 are connected, via a rounded corner, to the upstream end of respective leg portions 965 of the V-shaped body 956. The intermediate rib 958 likewise comprises a pair of side leg portions 987 connected together by a bottom leg portion 988. The upper ends of each of the side leg portions 987 are connected to aligned sections of the leg portions 965 of the V-shaped body 956, these sections being located between its upstream end downstream ends. The downstream rib 959 comprises a pair of side leg portions 989 connected together by a bottom leg portion 990. The upper ends of each of the side leg portions 989 are connected to the downstream ends of the leg portions 965 of the V-shaped body 956. The side leg portions 985, 987, and 989 decrease sequentially in height and the bottom leg portions 986, 988 and 990 decrease sequentially in width whereby the ribs 957, 958 and 959 sequentially decrease in the downstream direction.

The internal forming device 924 further comprises a longitudinal leg portion 991 which is has a rectangular strip shape, similar to the bottom leg portion 457 of the forming device 423 of the cushioning conversion machine 400. The leg portion 991 extends from the upstream rib 957, under and past the intermediate rib 958, and to the downstream rib 959. More particularly, the upstream end of the leg portion 991 is attached (i.e., welded) to a laterally central section of the bottom leg portion 986 of the upstream rib 957 and the downstream end of the leg portion 991 is attached (i.e., welded) to the bottom leg portion 990 of the downstream rib 959. (FIGS. 14 and 15.) The bottom surface of the longitudinal leg portion 991 defines a holding surface which holds the central region of the stock material as its lateral regions are inwardly turned in the turning space 953. More specifically, the leg portion 991 the holds the central region of the stock material at a predetermined distance from the chute's bottom wall 951 which is different than the distance that the stock material would pass in the absence of the leg portion 991.

The forming assembly 920 may additionally include a transverse guide device 992 mounted on the guide tray 913 just upstream of the inlet 948 of the chute 922. The guide device 992 may be in the form of a thin U-shaped bracket (or a three-sided hoop) having its distal ends secured to the guide tray 913 . Although not shown in the illustrated embodiment, the transverse guide device 992 may include side rollers, such as is shown in the transverse guide structure shown in U.S. Pat. No. 5,658,299. (This patent is assigned to the assignee of the present application and its entire disclosure is hereby incorporated by reference.)

As the stock material travels through the turning space 953 of the external forming device 922, the surfaces 950–952 radially restrict the stock material and the portions 964–965 of the internal forming device 924 define a turning perimeter around which the lateral regions of the stock material are inwardly turned. (FIG. 44A.) Particularly, the supporting portions 965 are coplanar portions sloped slightly in the downstream direction. (FIG. 44B.) The mandrel portions 964 project beyond the coplanar portion in both the lateral and non-lateral transverse directions. In this manner, the mandrel portions 964 internally shape the strip of stock material prior to it emerging from the chute's outlet 949. (FIG. 44C.) During this pre-outlet shaping, the upstream mandrel sections 981 play the dominate and the mandrel portions 964 of the internal forming device 924 are shaped to increase the lateral dimension and the non-lateral transverse dimension of the cross-sectional geometry of the strip of stock material.

Closing

Accordingly, the present invention provides the cushioning conversion machine 100, 200, 300 or 600 wherein the internal forming device 124, 224, 324 or 624 has at least one interacting portion 164, 264, 364 or 664 which is positioned downstream of the chute's outlet 149, 249, 349 or 649 and which is positioned to internally interact with lateral portions of the strip of stock material to internally reshape the cross-section geometry of the strip of stock material. The associated method includes the step of internally interacting with lateral portions of the strip of stock material to internally reshape the cross-section geometry of the strip of stock material downstream of the outlet 149, 249, 349 or 649.

The present invention also provides the cushioning conversion machine 200, 300, 400, 500 or 900 wherein the internal forming device 224, 324, 424, 524 or 924 comprises a pair of mandrel portions 264, 364, 464, 564 or 964 symmetrically positioned relative to the turning space 253, 353, 453, 553 or 953 and wherein the mandrel portions are located on at least one supporting portion 265, 365, 465, 565 or 965 and have a greater cross-sectional area than the supporting portion(s) 265, 365, 465, 565 or 965. The associated method includes the step of passing the stock material M through the external forming device 222, 322, 422, 522 or 922 and around the pair of mandrel portions 264, 364, 464, 564 or 964 that are laterally symmetrically positioned relative to the external forming device 222, 322, 422, 522 or 922.

The present invention additionally provides the cushioning conversion machine 300 wherein the internal forming device 324 comprises at least one interacting portion 364 which interacts with the strip of stock material to effect its cross-sectional geometry and a supporting portion 365 on which the interacting portions 364 are mounted and wherein the supporting portion 365 is mounted to the machine's housing 304 downstream of the outlet 349 of the external forming device 322.

The present invention further provides the cushioning conversion machines 400, 500 or 800 wherein the internal forming device 424, 524, 824, or 924 has portions 464–465, 564–565, 864–865 or 964–965 which define a turning perimeter around which lateral regions of the sheet stock material are inwardly turned and wherein the turning perimeter includes coplanar portions 465, 565, 865 or 965 and at least one mandrel portion 464, 564, 864 or 964 which projects beyond the coplanar portions 465, 565, 865 or 965. The associated method includes the step of turning the lateral regions of the stock material around the turning perimeter including the coplanar portions 465, 565, 865 or 965 and the at least one mandrel portion 464, 564, 864 or 964 which projects beyond the coplanar portions 465, 565, 865 or 965.

The present invention further provides the cushioning conversion machine 600 or 700 wherein the internal forming device 624 or 724 comprises at least one portion 657 or 757 defining a holding surface which holds a central region of the stock material as it travels through the turning space 653 or 753 and further comprises a mandrel portion 664 or 764 which is attached to a downstream end of the holding portion 657 or 757 and which has a section 685 or 785 which projects laterally outward from the downstream end of the portion 657 or 757. The associated method includes the step of passing the stock material around the mandrel portion 664 or 764.

The present invention still further provides the cushioning conversion machine 700 or 800 wherein the internal forming device 724 or 824 has portions 757, 785, 786 or 866, 886, 890 which define a holding surface holding central regions of the stock material as its lateral regions are inwardly turned in the turning space 753 or 853 and wherein the holding surface includes at least one protrusion 786 or 890 which projects perpendicularly beyond a plane extending from the downstream edge of the holding surface to the upstream edge of the holding surface. The associated method includes the step of holding the central region of the stock material as it travels through the turning space 653 or 753 with the portions 757, 785, 786 or 866, 886, 890.

The present invention still further provides the cushioning conversion machine 800 wherein the internal forming device 824 includes a pair of leg portions 865 and a nose portion 866 joining together the downstream ends of the leg portions 865. The leg portions 865 extend longitudinally through the turning space 853 and laterally converge towards each other. The nose portion has a transverse linear section positioned centrally relative to the turning space and extending in the lateral transverse direction.

Although the invention has been shown and described with respect to certain preferred embodiments, it is obvious that equivalent alterations and modifications will occur to others skilled in the art upon reading and understanding of this specification. The present invention includes all such equivalent alterations and modifications and is limited only by the scope of the following claims.

What is claimed is:

1. A cushioning conversion machine comprising a conversion assembly which converts sheet stock material into a thee-dimensional strip of cushioning;

the conversion assembly including a forming assembly that forms the stock material into a strip of cushioning and a feeding assembly downstream of the forming assembly that feeds the stock material through the forming assembly;

the feeding assembly including at least one rotating feed member that engages the stock material for feeding the stock material through the forming assembly;

the forming assembly including an external forming device and an internal forming device;

the external forming device having an inlet, an outlet and surfaces therebetween that define a turning space;

the internal forming device being positioned relative to the external forming device so that the stock material passes through the turning space and around the internal forming device as it travels through the forming assembly;

the internal forming device including a pair of mandrel portions symmetrically positioned relative to the turning space to internally expand the strip of cushioning thereby to vary a density characteristic of the strip; and the mandrel portions progressing from a smaller width section to a greatest width section downstream of the smaller width section and upstream of the at least one rotating feed member.

2. A cushioning conversion machine as set forth in claim 1, wherein the internal forming device interacts with the stock material downstream of the external forming device.

3. A cushioning conversion machine as set forth in claim 1, wherein the mandrel portions are located on respective supporting portions of the internal forming device, the mandrel portions having a greater cross-sectional area than the supporting portions.

4. A cushioning conversion machine as set forth in claim 3, wherein the mandrel portions and the supporting portions are separate members and the mandrel portions are mounted on the supporting portions of the internal forming device.

5. A cushioning conversion machine as set forth in claim 3, wherein the mandrel portions are adjustably attached to the downstream end of the supporting portions whereby the position of the mandrel portions relative to the outlet of the external forming device may be selectively adjusted.

6. A cushioning conversion machine as set forth in claim 3, wherein the supporting portions include a pair of leg portions extending longitudinally through the turning space and laterally converging towards each.

7. A cushioning conversion machine as set forth in claim 6, wherein the internal forming device has a nose portion joining together the downstream ends of the leg portions, the nose portion having a transverse linear section positioned centrally relative to the turning space and extending in the lateral transverse direction.

8. A cushioning conversion machine as set forth in claim 1, wherein the mandrel portions of the internal forming device are positioned to extend downstream of the outlet of the external forming device.

9. A cushioning conversion machine as set forth in claim 1, wherein the external forming device is a chute having an inlet and an outlet and wherein the chute has substantially continuous walls extending between the inlet and the outlet, and wherein the chute is a converging chute whereby the inlet has a greater cross-sectional area than the outlet and the walls taper inwardly in a downstream direction.

10. A cushioning conversion machine as set forth in claim 1, wherein the mandrel portions include an approximate cone shape having a height dimension generally aligned parallel to a path of the stock material through the forming assembly.

* * * * *